US006343787B1

(12) United States Patent
Kato et al.

(10) Patent No.: US 6,343,787 B1
(45) Date of Patent: Feb. 5, 2002

(54) SHEETING TRANSPORT APPARATUS HAVING ANTI-POSITIONAL OFFSET MECHANISM

(75) Inventors: Kenichi Kato; Tsuyoshi Tanabe, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/438,355

(22) Filed: Nov. 12, 1999

(30) Foreign Application Priority Data

Nov. 12, 1998 (JP) ..... 10-322093

(51) Int. Cl.[7] ..... B65H 5/04

(52) U.S. Cl. ..... 271/274; 347/104; 400/625; 400/645

(58) Field of Search ..... 271/274; 347/104, 347/105; 400/624, 625, 645, 641, 642

(56) References Cited

U.S. PATENT DOCUMENTS

| | | | | |
|---|---|---|---|---|
| 4,620,807 A | * | 11/1986 | Polit | 271/274 X |
| 5,527,123 A | * | 6/1996 | Jackson et al. | 400/642 |
| 5,646,667 A | * | 7/1997 | Broder et al. | 347/104 |
| 5,673,074 A | * | 9/1997 | Miyauchi et al. | 347/104 |
| 5,808,647 A | * | 9/1998 | Kurata et al. | 347/404 |
| 5,988,903 A | * | 11/1999 | Baitz et al. | 347/104 X |
| 5,993,094 A | * | 11/1999 | Lee | 400/641 X |
| 6,089,773 A | * | 7/2000 | Bailey et al. | 400/642 |
| 6,126,347 A | * | 10/2000 | Sakaino et al. | 400/642 |

FOREIGN PATENT DOCUMENTS

| | | | |
|---|---|---|---|
| JP | 62-135064 | 6/1987 | H04N/1/04 |
| JP | 62-167150 | 7/1987 | B65H/5/06 |
| JP | 63-67859 | 3/1988 | H04N/1/00 |
| JP | 5-281635 | * 10/1993 | |

* cited by examiner

*Primary Examiner*—Christopher P. Ellis
*Assistant Examiner*—Patrick Mackey
(74) *Attorney, Agent, or Firm*—Sughrue Mion, PLLC

(57) ABSTRACT

There is provided a sheeting transport apparatus comprising two roller pairs as a component of an auxiliary scan transport mechanism in optical beam scanners and an anti-positional offset mechanism that is provided between the two roller pairs to prevent any positional offset of sheeting that may occur in the depth direction from the optical scan position, for example a retaining roller pair including a fixed roller and a retainer roller capable of adjusting the force of urging the fixed roller. This apparatus further includes opening and closing mechanisms for independently advancing or retracting a roller of each roller pair with respect to a fixed roller, and drive units thereof. This apparatus is a small, compact and low-cost apparatus that is simple in configuration and which yet is optimal for precise image reading and recording purposes. The apparatus is capable of suppressing the adverse effects of curl and other undesirable phenomena in the sheeting. Any positional offsets in the depth direction such as upward departure from the light scanning position are eliminated or reduced thereby ensuring that the sheeting is maintained adequately flat during transport in the auxiliary scanning direction.

23 Claims, 8 Drawing Sheets

SHEETING TRANSPORT APPARATUS HAVING ANTI-POSITIONAL OFFSET MECHANISM

BACKGROUND OF THE INVENTION

This invention relates to a sheeting transport apparatus with which a sheet of material to be scanned, namely, sheeting, is transported with two roller pairs in an auxiliary scanning direction for recording an image on the sheeting or reading the image on the sheeting as it is illuminated with light beams. More particularly, the invention relates to the technical field of sheeting transport apparatus in an optical beam scanner that scans sheeting with light beams deflected or aligned in a one-dimensional direction to record an image on the sheeting (in the case of an image recording apparatus) or read the image recorded on the sheeting (in the case of an image reading apparatus).

In current radiation image information reading apparatus, a stimulable phosphor sheet having radiation energy stored therein as image information is illuminated with exciting light such as laser light so that the stored radiation energy is emitted to produce photo-stimulated luminescence, which is detected with a photodetector such as a photomultiplier to read the radiation image information photoelectrically. For two-dimensional reading of the radiation image information stored in the stimulable phosphor sheet, the optical beam scanner in the radiation image information reading apparatus performs main scanning of the sheet with one-dimensionally deflected laser light as it is transported in an auxiliary scanning direction generally perpendicular to the main scanning direction. A mechanism commonly used in the optical beam scanner to transport the stimulable phosphor sheet or other types of sheeting in an auxiliary scanning direction is a sheeting transport apparatus that employs two roller pairs spaced apart by a distance shorter than the length of the sheeting in the auxiliary scanning direction (see, for example, Unexamined Published Japanese Patent Application (kokai) Nos. 135064/1987, 167150/1987 and 67859/1988).

In the sheeting transport apparatus, the sheeting such as a stimulable phosphor sheet often receives an impact when it goes into or emerges from a pair of rollers. To avoid this problem, one of the two rollers in pair, namely, a nip roller, is brought out of engagement with the other (fixed roller) when the sheeting goes into or emerges from the roller pair. By thusly avoiding the occurrence of impacts on the sheeting, the latter is prevented from vibrating or being offset in position and, as a result, the sheeting is transported in an auxiliary scanning direction smoothly and precisely enough to enable precise reading of the image information. According to commonly assigned Unexamined Published Japanese Patent Application (kokai) No. 281635/1993, there is disclosed an improved mechanism for transporting sheeting in an auxiliary scanning direction using two such roller pairs and it is a compact sheeting transport apparatus of simple construction that uses a single actuator to have the nip roller disengaged from the fixed roller either when the sheeting goes into the roller pair or when it emerges from the roller pair.

In the image recording art, there are used photoprinters with which the images recorded on photographic films such as negatives and reversals (which are hereinafter referred to simply as "films") are printed on light-sensitive materials such as photographic paper and later developed to produce finished photographic prints. Such photoprinters have heretofore been of an analog type that performs areal exposure (direct exposure) of the film image by projecting it onto the light-sensitive material. The assignee has recently commercialized a digital photoprinter which operates in the following manner: the film image is read photoelectrically with an image sensor such as CCD in an image reading apparatus such as a scanner, converted to digital image data which is then subjected to specified image processing schemes in an image processing apparatus; in the optical beam scanner in an image recording apparatus (printing apparatus), a light-sensitive material is scan exposed with recording light beams modulated in accordance with the processed digital image data to record an image (latent image), subjected to development and other necessary treatments with a developing apparatus and output as a finished photographic print.

In the digital photoprinter, the film image is read photoelectrically, converted to digital image information (data) and thereafter subjected to digital image processing in which tonal correction and other schemes are performed to determine the exposing conditions. Therefore, by digital image processing, not only jobs of editing printed images such as assembling a plurality of images and splitting a single image into two or more images but also various image processing schemes such as color/density adjustments, edge enhancement, dodging, peripheral luminance correction, the correction of distortion and the correction of chromatic aberrations can be performed in any desired manner to output prints that meet specific needs of the user. In addition, the image data about the printed images can be supplied to a computer and other processing equipment or stored in recording media such as a floppy disk.

Another advantage of the digital photoprinter is that it is capable of outputting prints of better image quality than those produced by the conventional direct exposure technique in various aspects including resolution, the fidelity in color/density reproduction, and so forth.

Despite these desirable features, the digital photoprinter developed by the assignee has problems. In the image printing apparatus used as an image recorder, a web of light-sensitive material is unreeled and transported in an auxiliary scanning direction as it is repeatedly subjected to main scanning with one-dimensionally deflected light beams so that a number of images are recorded on the uninterrupted length of the light-sensitive material. The exposed light-sensitive material is also developed in a continuous form and finally cut to a specified, image-dependent length, thereby producing discrete finished prints. This approach is capable of volume processing in a very high efficiency. On the other hand, the system is so bulky that small-lot processing can only be accomplished with considerable difficulty. What is more, the system is too expensive and bulky to be suitable for use in small-lot processing.

Under the circumstances, there is a strong need for a printing apparatus that can be used with the digital photoprinter such that a web of light-sensitive material is cut to discrete sheets of a print-dependent length and thereafter scan exposed with light beams. The printing apparatus (which is hereunder referred to as a "sheet-fed image recording apparatus") allows for realizing a smaller system and considerable reduction in the equipment and running costs.

One may contemplate operating the sheet-fed image recording apparatus with the sheeting transport apparatus described in Unexamined Published Japanese Patent Application (kokai) No. 281635/1993, supra, that employs two roller pairs and which is used as a mechanism for transporting sheets in an auxiliary scanning direction in an optical beam scanner in a radiation image information reading apparatus.

In the sheet-fed image recording apparatus, a web of light-sensitive material is unreeled and cut to sheets of a given length; therefore, the individual sheets of light-sensitive material are not completely flat but "curl" to some extent. Since the light-sensitive material in a cassette is commonly wound up in roll form with the emulsion-coated side facing outward, a convex curl remains with the emulsion-coated side facing outward after the light-sensitive material has been cut to sheets.

Suppose that such "curling" sheets of light-sensitive material are transported in an auxiliary scanning direction with the sheeting transport apparatus described in Unexamined Published Japanese Patent Application (kokai) No. 281635/1993, supra that employs two spaced roller pairs. If each sheet of light-sensitive material is exposed imagewise starting at its advancing end, imagewise scan exposure is performed in the image recording (exposing) position between the roller pairs as the sheet is transported in the auxiliary scanning direction in a so-called "cantilevered" state (it is nipped by either the upstream or downstream roller pair) in the following two periods, one taken for the advancing end of the sheet to pass through the upstream roller pair and the exposing position to reach the downstream roller pair and the other period taken for the trailing end of the sheet to pass through the upstream roller pair and the exposing position to reach the downstream roller pair. As a consequence, both the advancing and trailing end portions of the curling light-sensitive material experience variations in the optical pathlength in the depth direction, which result in exposure unevenness, hence, density unevenness.

In other words, the sheeting transport apparatus under discussion is capable of reducing to some extent the exposure unevenness (density unevenness) due to load variations such as impact, vibration and positional offset that occur when the sheet of light-sensitive material goes into or emerges from a pair of rollers. However, the apparatus is not primarily intended to prevent the occurrence of curl in the light-sensitive material which is sheeting to be scanned and, hence, it cannot be maintained completely flat in the exposing position. As a result, the problem of exposure unevenness persists.

In short, if two roller pairs used to transport sheets of light-sensitive material are spaced apart by a large distance, more of the light-sensitive material in sheet form is "cantilevered" during transport and any curl that is inherent in it becomes correspondingly pronounced in the exposing position, causing scan exposure of the curling and elevated area of the sheet and making impossible to achieve exposure in a uniform and appropriate optical pathlength. As a result, exposure unevenness tends to occur in both the advancing and trailing end portions of the light-sensitive material, making it difficult to obtain prints of high image quality.

SUMMARY OF THE INVENTION

The present invention has been accomplished under these circumstances and has as an object providing a small, compact and low-cost sheeting transport apparatus that is simple in configuration and which yet is optimal for precise image reading and recording purposes. The apparatus uses two roller pairs as a component of an auxiliary scan transport mechanism in optical beam scanners and with this apparatus, sheeting or sheets to be scanned such as light-sensitive material in sheet form can be transported smoothly and precisely in an auxiliary scanning direction. In addition, the apparatus is capable of suppressing the adverse effects of curl and other undesirable phenomena in the sheeting; namely, any positional offsets in the depth direction, such as upward departure from the light scanning position that occurs in the advancing and trailing end portions of the sheeting due to curl and other undesirable effects are eliminated or reduced to a very small tolerable limit, thereby ensuring that the sheeting is maintained adequately flat during transport in the auxiliary scanning direction.

This object of the invention can be attained by a sheeting transport apparatus that transports a sheeting on which is performed optical scan in a one-dimensional direction in an auxiliary scanning direction generally perpendicular to the one-dimensional direction, comprising: a first roller pair and a second roller pair that are spaced apart by a distance shorter than a length of the sheeting in the auxiliary scanning direction, wherein the sheeting is transported in the auxiliary scanning direction as it is nipped by the first roller pair and the second roller pair; and an anti-positional offset mechanism that is provided between the first and second roller pairs to ensure that the sheeting has no positional offset from an optical scan position in which the sheeting is scanned optically in a depth direction.

In a preferred embodiment, the anti-positional offset mechanism is provided between the first and second roller pairs at least one of upstream and downstream of the optical scan position of the sheeting. In a further preferred embodiment, the anti-positional offset mechanism is provided between the first and second roller pairs upstream of the optical scan position of the sheeting.

The present invention also provides the sheeting transport apparatus that further comprises: an optical scan guide that is provided between the first and second roller pairs to support the sheeting in the optical scan position from its underside, wherein the anti-positional offset mechanism prevents upward departure of the sheeting from the optical scan guide.

The present invention also provides the sheeting transport apparatus in which the first roller pair is positioned upstream of the second roller pair and includes a first roller driven rotationally and a first nip roller that can move either toward or away from the first roller and the second roller pair is positioned downstream of the first roller pair and includes a second roller driven rotationally and a second nip roller that can move either toward or away from the second roller, and that further comprises: a first opening and closing mechanism that engages the first nip roller and advances or retracts it depending on transport of the sheeting to either open or close the first roller pair; and a second opening and closing mechanism that engages the second nip roller and advances or retracts it depending upon the transport of the sheeting to either open or close the second roller pair.

In each of the embodiment described above, the first opening and closing mechanism is any one of a cam mechanism and a drive unit thereof, a solenoid mechanism, a rotary solenoid mechanism, a rack-and-pinion mechanism and a drive unit thereof as well as a linear guide mechanism and a drive unit thereof, and the second opening and closing mechanism is any one of a cam mechanism and a drive unit thereof, a solenoid mechanism, a rotary solenoid mechanism, a rack-and-pinion mechanism and a drive unit thereof as well as a linear guide mechanism and a drive unit thereof.

In another preferred embodiment, the first opening and closing mechanism comprises a first cam mechanism and a drive unit of the first cam mechanism, and wherein the second opening and closing mechanism comprises a second cam mechanism and a drive unit of the second cam mechanism.

In still another preferred embodiment, the drive unit of the first cam mechanism and the drive unit of the second cam mechanism are a single common drive source that drives the first and second cam mechanisms in unison such that the first roller pair or the second roller pair is selectively opened and closed.

In yet another preferred embodiment, the first cam mechanism has: a first rocking member that rotatably supports the first nip roller; and a first cam member that engages the first rocking member to move the first nip roller either toward or away from the first roller; the second cam mechanism has: a second rocking member that rotatably supports the second nip roller; and a second cam member that engages the second rocking member to move the second nip roller either toward or away from the second roller; and the first and second cam members have: a single common rotating shaft to which the single common drive source working as a rotational drive source is coupled.

In another preferred embodiment, the first rocking member has: a first bracket that rotatably supports the first nip roller and makes reciprocal movements to come closer to or depart from the first roller; a first pivoting member that pivots in engagement with the first bracket member and the first cam member; and a first urging device that urges the first bracket such that the first nip roller is pressed against the first roller; and the second rocking member has: a second bracket that rotatably supports the second nip roller and makes reciprocal movements to come closer to or depart from the second roller; a second pivoting member that pivots in engagement with the second bracket and the second cam member; and a second urging device that urges the second bracket such that the second nip roller is pressed against the second roller.

In still another preferred embodiment, the first and second cam members are a single common eccentric cam and the first and second pivoting members have a single common pivoting shaft.

In yet another preferred embodiment, the anti-positional offset mechanism comprises: a retaining roller pair for nipping the sheeting to be held in the optical scan position and a nipping force adjusting mechanism, the retaining roller pair having a rotatable fixed roller and a rotatable retainer roller which is adjustable in a nipping force that nips the sheeting in cooperation with the fixed roller, and the nipping force adjusting mechanism engaging the retainer roller to adjust the nipping force by which the sheeting is nipped between the retainer roller and the fixed roller.

In another preferred embodiment, the nipping force adjusting mechanism comprises a third rocking member that rotatably supports the retainer roller, a third urging device that urges the rocking member such that the retainer roller is pressed against the fixed roller, and an urging force adding device that adds or relieves an urging force by which the third urging device urges the third rocking member.

In still another preferred embodiment, the urging force adding device adds or relieves the urging force by which the third urging device urges the third rocking member depending upon whether the first nip roller is moved toward or away from the first roller by means of the first cam mechanism.

In yet another preferred embodiment, the urging force adding device relies upon the first rocking member in the first cam mechanism to add or relieve the urging force by which the third urging device urges the third rocking member.

In another preferred embodiment, the urging force adding device further includes a fourth rocking member that engages the first bracket in the first rocking member in the first cam mechanism, the third rocking member has a rocking shaft through the fourth rocking member, the third urging device urges the third rocking member with respect to the fourth rocking member, and the reciprocal movements of the first bracket help add and relieve the urging force by which the third urging device urges the third rocking member.

In still another preferred embodiment, the third rocking member is split into more than one segment in the main scanning direction and each segment has the retainer roller, the fixed roller and the third urging device.

In yet another preferred embodiment, the retainer roller for each segment is subdivided into smaller sub-segment rollers, the fixed roller for each segment is subdivided into two subdivided rollers that are provided only at both ends of the third rocking member and that are respectively in contact with the smaller sub-segment rollers of the retainer roller at both ends.

In another preferred embodiment, each of the retainer roller and the fixed roller has split rollers.

In still another preferred embodiment, the fixed roller is rotatably supported on the optical scan guide.

In yet another preferred embodiment, the sheeting transport apparatus is an auxiliary scan transport mechanism of an image recording apparatus and the sheeting is a light-sensitive material, and wherein the fixed roller is provided so as to avoid a back print position or back print positions used for back printing with a back printer, when the image recording apparatus comprises the back printer.

In another preferred embodiment, the optical scan guide has a plurality of curved pawls in a comb shape which are provided in the one-dimensional direction, which extend upstream in the auxiliary scanning direction and each of which has a forward end being curved inwardly.

In still another preferred embodiment, the optical scan guide has a plurality of straight pawls in a comb shape which are provided in the one-dimensional direction and which extend downstream in the auxiliary scanning direction.

DETAILED DESCRIPTION OF THE INVENTION

The sheeting transport apparatus of the invention is hereunder described in detail with reference to the preferred embodiments shown in the accompanying drawings.

Figure 1:
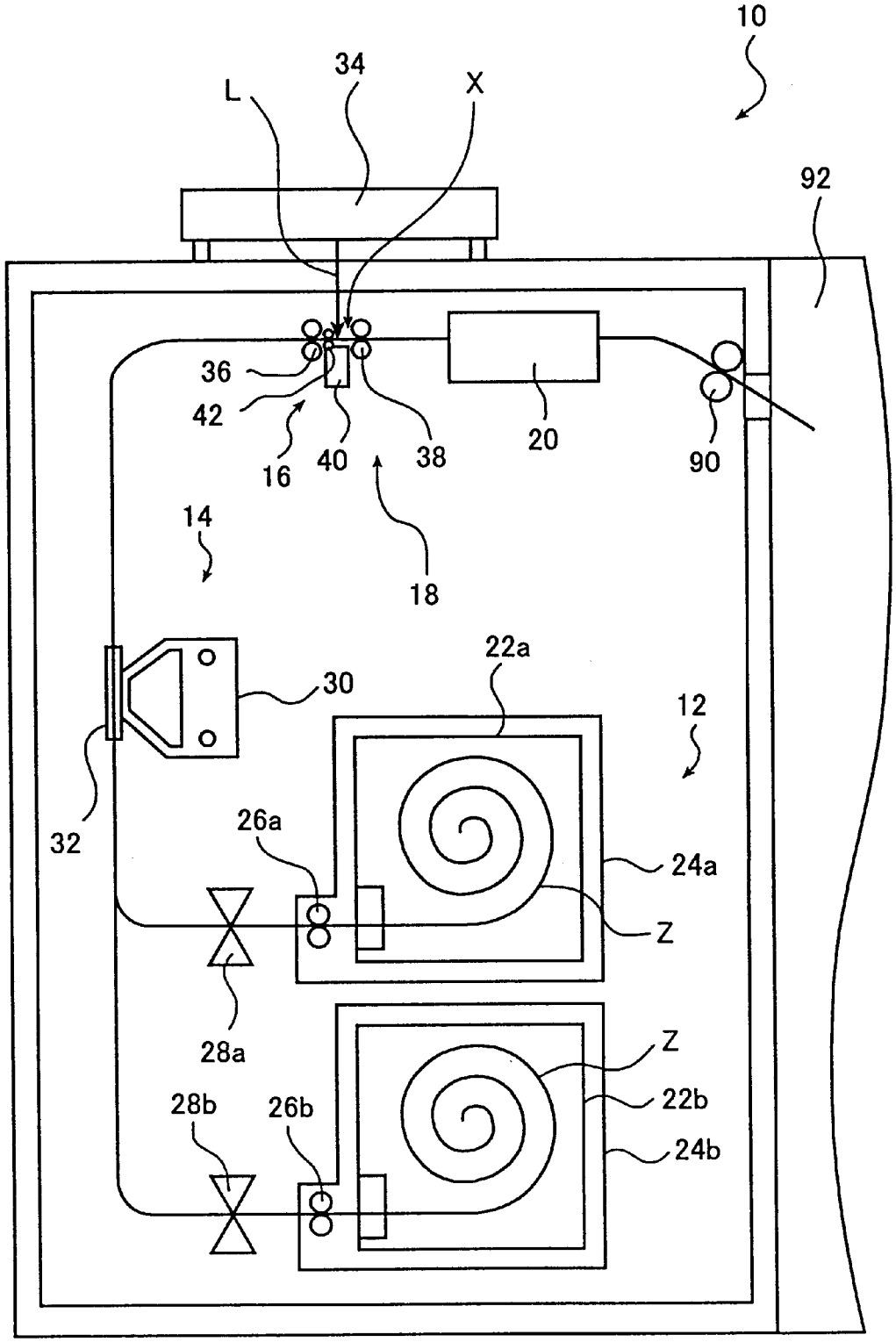
FIG. 1 shows in conceptual form the basic layout of an embodiment of an image recording apparatus to which the sheeting transport apparatus of the invention is applied as an auxiliary scan transport unit.

FIG. 1 shows the basic layout of an image recording apparatus to which the sheeting transport apparatus of the invention is applied as an auxiliary scan transport mechanism.

The image recording apparatus generally indicated by 10 in FIG. 1 (and which is hereunder referred to simply as a "recording apparatus") is such that a web of photographic material placed in roll form within a magazine is unreeled and cut to individual sheets of a specific length determined by the prints to be finally produced and, after back printing (recording of a back print) and digital scan exposure of the photographic material as it is transported in an auxiliary scanning direction by means of two roller pairs in the sheeting transport apparatus of the invention, the exposed light-sensitive material Z is supplied into a developing machine (also called "processor"). Having these capabilities, the recording apparatus 10 comprises a light-sensitive material supply section 12, a back printing section 14, a recording section 18 having an auxiliary scan transport unit 16 to which the sheeting transport apparatus of the invention is applied, and a distributing section 20.

Transport devices for transporting the light-sensitive material Z such as transport rollers, transport guides, sensors for detecting the light-sensitive material and various other members commonly employed in known image recording apparatus are provided as required in the recording apparatus 10 although these are omitted from FIG. 1 in order to clarify the basic layout of the apparatus. Needless to say, the transport rollers provided as transport devices are spaced apart by a distance smaller than the minimum possible length of a cut sheet of light-sensitive material Z in order to ensure that they do not interfere with the transport of the light-sensitive material Z.

The light-sensitive material supply section 12 has two loaders 24*a* and 24*b* that are respectively loaded with magazines 22*a* and 22*b* each containing a roll of light-sensitive material Z in a lightproof case, with the emulsion-coated side (light-sensitive layer side) facing outward. The magazines 22*a* and 22*b* contain withdrawing roller pairs 26*a* and 26*b*, respectively, in positions that correspond to the port through which the light-sensitive material Z is withdrawn. Cutters 28*a* and 28*b* corresponding to the loaders 24*a* and 24*b*, respectively, are provided downstream of and close to the withdrawing roller pairs 26*a* and 26*b* in the magazines 22*a* and 22*b* loaded within the loaders 24*a* and 24*b*.

As shown in FIG. 1, the recording apparatus 10 has the loader 24*b* positioned below the loader 24*a* and the recording position X lies above the loader 24*a*.

The illustrated recording apparatus 10 is capable of loading with two magazines 22*a* and 22*b* which are usually adapted to contain different types of light-sensitive material Z which are characterized by their size (width), surface gloss (silk-finish, matte and so forth), specifications (e.g., thickness and base type), and so forth. Needless to say, the magazines 22*a* and 22*b* may contain the same type of light-sensitive material Z. It should also be noted that the number of magazines that can be loaded in the illustrated recording apparatus 10 is by no means limited to two and that it may be adapted to be capable of loading with only one magazine or three or more magazines.

In the light-sensitive material supply section 12 described above, the withdrawing roller pair 26*a* or 26*b* withdraws the light-sensitive material Z from the corresponding magazine and transports it to the downstream back printing section 14. The transport of the light-sensitive material Z stops at the point of time when it has been transported downstream from the cutter 28*a* or 28*b* by a length corresponding to each of the prints to be produced. Subsequently, the cutter 28*a* or 28*b* turns on to cut the light-sensitive material Z to a sheet of a specified length.

The recording apparatus 10 shown in FIG. 1 is adapted to be such that two cutters 28*a* and 28*b* are provided in association with two magazines 22*a* and 22*b* and that the light-sensitive material Z withdrawn from these magazines is cut with different cutters 28*a* and 28*b*; however, this is not the sole case of the invention and the light-sensitive material Z may be cut with a common cutter.

The light-sensitive material Z that has been unreeled from the supply section 12 and thusly cut to individual sheets is then transported to the back printing section 14 in an upper position.

The back printing section 14 is a site where a back print consisting of various kinds of back print information such as the date when the picture was taken, the date of printing (exposure), frame number, film identification (ID) number (code), ID number of the camera used to take the picture and ID number of the photoprinter is recorded on the reverse side of the light-sensitive material Z (where no emulsion is coated).

Having this capability, the back printing section 14 may use a dot-impact back printer 30 as an impact printing apparatus to record back print information on the light-sensitive material Z being transported with the aid of a guide 32. This is not the sole example of the methods and apparatus (printers) for recording back print information and various back print information recording methods and apparatus used in known photoprinters may be employed, as exemplified by an ink-jet printer and thermal transfer printer. Among these, a non-impact recording method and apparatus such as an ink-jet printer may be employed with advantage since being of a non-impact type, it is free from the load variations that may be caused on scan transport by the recording of back print information. A particularly preferred printer is an ink-jet printer that uses a heat-fusible ink that is water-insoluble and which is solid at ordinary temperatures.

To be compatible with the recently developed Advanced Photo System, the back printing section 14 is preferably adapted to be capable of marking at least two lines at a time.

The light-sensitive material Z that has been cut to a specified length and thusly subjected to the recording of back print information is then transported to the recording section 18 (auxiliary scan transport unit 16). The recording section 18 has an exposing optical unit (hereunder referred to as an "exposing unit") 34 and the auxiliary scan transport unit 16 applying the sheeting transport apparatus of the invention. In the illustrated recording apparatus 10, image recording with the exposing unit 34 is done by so-called "digital scan exposure", in which the light-sensitive material Z in sheet form is transported by the transport unit 16 in the auxiliary scanning direction as it is scan exposed in the recording (exposing) position X with optical beams (recording light L) modulated in accordance with the digital image data and deflected in the main scanning direction (normal to the paper of FIG. 1) which is generally perpendicular to the auxiliary scanning direction.

The exposing unit 34 is an optical unit for performing the above-described digital scan exposure and it may be realized by a known optical beam scanner which, although not shown, is composed essentially of light sources which issue optical beams for exposing the light-sensitive material Z with red (R), green (G) and blue (B) lights, a modulating device such as AOM (acoustic optical modulator) which modulates the issued light beams in accordance with digital image data, a light deflector such as a polygonal mirror which deflects the modulated light beams in the main scanning direction generally perpendicular to the auxiliary scanning direction, and an fθ (scanning) lens with which the deflected light beams are focused to specified beam spot sizes at a specified point in the recording position X (on the scanning line).

The exposing unit 34 is by no means limited to this known type of optical beam scanner and it may be replaced by various kinds of digital exposing units that use various arrays of light-emitting devices and spatial modulating devices which extend in the main scanning direction perpendicular to the auxiliary scanning direction such that the light-sensitive material Z is exposed with a plurality of light beams arranged in the main scanning direction and modulated with digital image signals. A specific example is a digital exposing unit using a PDP (plasma display) array, an ELD (electroluminescent display) array, an LED (light-emitting diode) array, an LCD (liquid-crystal display) array, a DMD (digital micromirror device) array, or a laser array.

Figure 2:
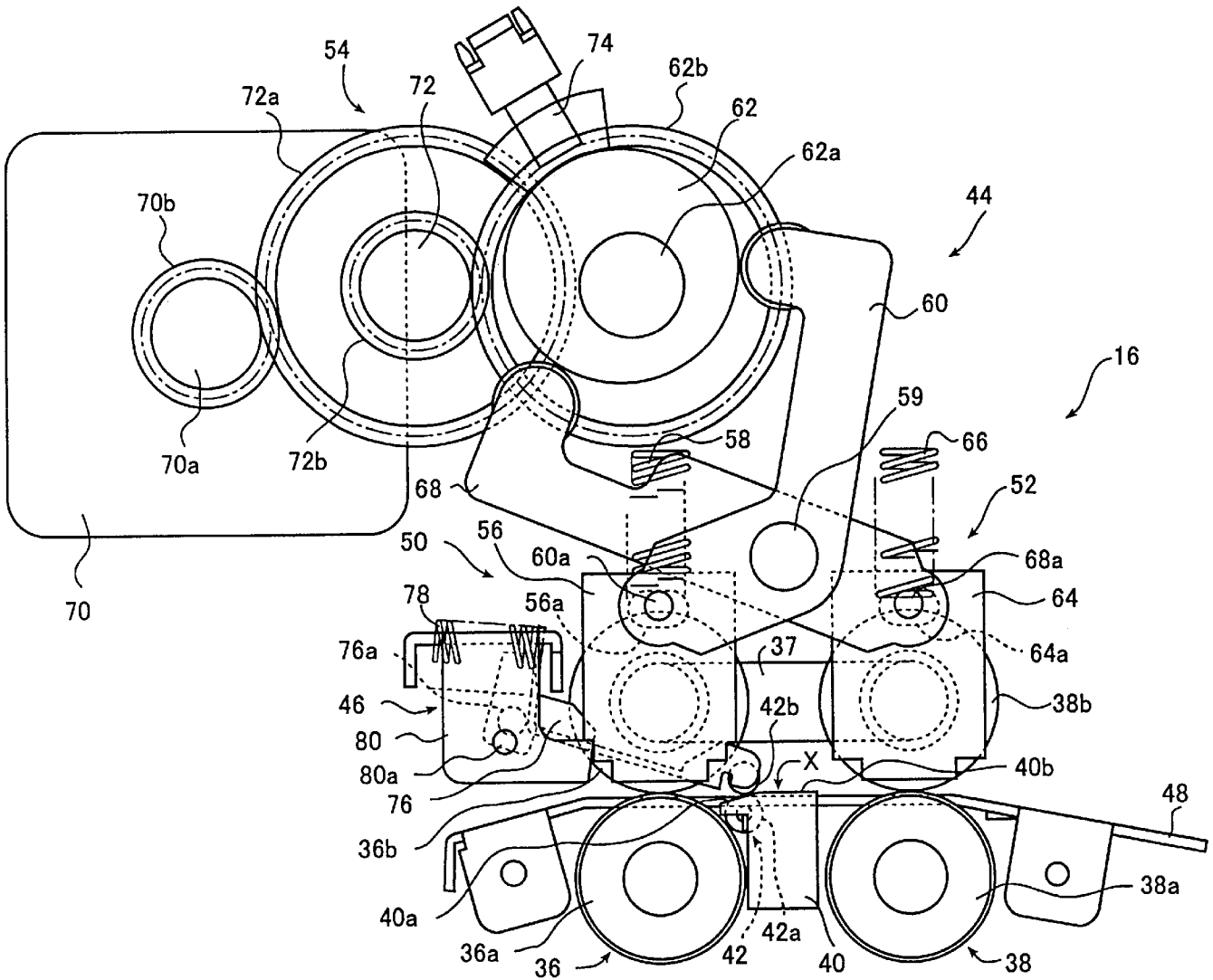
FIG. 2 is a diagrammatic side view of the auxiliary scan transport unit used in the image recording apparatus shown in FIG. 1.

FIG. 2 is a diagrammatic side view of the auxiliary scan transport unit 16. The auxiliary scan transport unit 16 applies the sheeting transport apparatus of the invention, in which the sheet of light-sensitive material Z which is the sheeting contemplated by the invention, or the sheet to be scanned, is nipped between two rollers and transported in the auxiliary scanning direction generally perpendicular to the main scanning direction in synchronism with the optical scan by the exposing unit 34 in the main scanning direction. Having this capability, the auxiliary scan transport unit 16 comprises the following components: two transport roller pairs, one being the upstream transport roller pair (hereunder referred to as the "first roller pair") 36 and the other being the downstream transport roller pair (hereunder referred to as the "second roller pair") 38, which are on opposite sides of the recording (main scanning) position X defining the main scanning line and are spaced apart by a distance shorter than the length of the sheet of light-sensitive material Z in the auxiliary scanning direction; an optical scan guide 40 in the recording position X between the two transport roller pairs 36 and 38; a retaining roller pair 42 provided between the first roller pair 36 and the recording position X in a location near to and upstream of the recording position X and which is one of the most characterizing parts of the present invention; an opening and closing mechanism 44 which opens or closes the two transport roller pairs 36 and 38 as the sheet of light-sensitive material Z goes into and emerges from those roller pairs; a mechanism 46 for adjusting the nipping force of the retaining roller pair 42; a transport guide 48; a synchronous drive unit (not shown) that synchronously drives the first and second roller pairs 36 and 38; and an advancing end detecting sensor (not shown) provided in a specified position upstream of the first roller pair 36 to detect the advancing end of the light-sensitive material Z in sheet form.

The illustrated auxiliary scan transport unit 16 which applies the sheeting transport apparatus of the invention uses the retaining roller pair 42 to ensure that the sheet of light-sensitive material Z will not experience any curl or otherwise induced positional offset in the depth direction such as an upward departure from the recording position X, thus allowing the sheet of light-sensitive material Z to be held correctly in the recording position X above the optical scan guide 40 throughout its transport in the auxiliary scanning direction generally perpendicular to the main scanning direction as it is nipped between the transport roller pairs 36 and 38. As already mentioned, the light beams L are deflected in the main scanning direction, so the light-sensitive material Z is scan exposed two-dimensionally with these light beams to form a latent image.

The first roller pair 36 is composed of a rotationally driven first drive roller 36*a* of a fixed type and a first nip roller 36*b* that is rotated by slidable contact with this drive roller 36*a*. The second roller pair 38 is composed of a rotationally driven second drive roller 38*a* of a fixed type and a second nip roller 38*b* that is rotated by slidable contact with this drive roller 38*a*. The optical scan guide 40 is positioned between the transport roller pairs 36 and 38 and it is a member having an inclined portion 40*a* and a flat portion 40*b*. In order to ensure that it can positively receive the "curly" advancing end of light-receiving material Z as it is transported by the first roller pair 36, the inclined portion 40*a* slopes upward to the right (downstream the transport of the light-sensitive material Z) to a position almost equal in height to the recording position X and guides said advancing end into the retaining roller pair 42. The flat portion 40*b* ensures that the light-sensitive material Z being transported as it is nipped by the retaining roller pair 42 is received flat in the recording position X. The first drive roller 36*a* and the second drive roller 38*a* are driven synchronously by a synchronous drive unit (not shown). To give just one example (not shown), they may be coupled together with a timing belt, one of them being coupled to a drive source either directly or via a variable speed mechanism. It should, however, be noted that the specific layout of synchronously driving the two drive rollers is by no means limited. The first and second nip rollers 36*b* and 38*b* are coupled with a timing belt 37 so that when one of them is driven by contact with the mating drive roller, the retracting nip roller in the other roller pair that has opened is driven synchronously.

The retaining roller pair 42 is located between the first roller pair 36 and the recording position X on the optical scan guide 40 and upstream of the recording position X; it is composed of a small-diameter fixed roller 42*a* that can be rotated by slidable contact with the light-sensitive material z being transported (said roller 42*a* is hereunder referred to simply as "fixed roller") and a small-diameter retainer roller 42*b* that cooperates with the fixed roller 42*a* to nip the light-sensitive material Z being transported and which is rotated by slidable contact with the light-sensitive material Z. The force by which the retainer roller 42*b* nips the light-sensitive material Z together with the fixed roller 42*a* is adjustable. It should be noted that the retaining roller pair 42 is located the closest possible to the recording position X.

The opening and closing mechanism 44 for opening or closing the first and second roller pairs 36 and 38 comprises the following components: a first cam mechanism 50 that engages the first nip roller 36*b* in the first roller pair 36 to move it either toward or away from the first drive roller 36*a*; a second cam mechanism 52 that engages the second nip roller 38*b* in the second roller pair 38 to move it either toward or away from the second drive roller 38*a*; and a drive mechanism 54 for driving the first cam mechanism 50 and the second cam mechanism 52.

The first cam mechanism 50 comprises the following components: a first bracket 56 that rotatably supports the first nip roller 36*b* and which makes reciprocal movements in the direction in which the first nip roller 36*b* moves either toward or away from the first drive roller 36*a* (i.e., vertically in FIG. 2); a first urging spring 58 that urges the first bracket 56 in the direction in which the first nip roller 36*b* is pressed against the first drive roller 36*a* (i.e., downward in FIG. 2); a first pivoting member 60 that engages the first bracket 56 to pivot about a fixed shaft 59; and an eccentric cam 62 that engages the first pivoting member 60 to pivot it such that the first bracket 56 is moved in the direction in which the first nip roller 36*b* is retracted (i.e., upward in FIG. 2). The engagement between the first bracket 56 and the first pivoting member 60 is established by a prolate hole 56*a* in the first bracket 56 that is large enough to permit its reciprocal movement vertically in FIG. 2 and a pin 60*a* erected at an end of the first pivoting member 60. To retract the first nip roller 36*b* (so that it moves away from the first drive roller 36*a*), namely, to move the first bracket 56 upward in FIG. 2, the eccentric cam 62 causes the first pivoting member 60 to pivot, whereupon the pin 60*a* contacts the upper side of the prolate hole 56*a* in the first bracket 56 to lift it counteracting the urging force of the first urging spring 58. To advance the first nip roller 36*b* (so that it comes into contact with the first drive roller 36*a*), namely, to move the first bracket 56 downward in FIG. 2, not only the eccentric cam 62 causes the first pivoting member 60 to pivot but also the first urging spring 58 urges the first bracket 56 downward in FIG. 2; once the pin 60*a* on the first pivoting member 60 has come out of engagement with the upper side of the prolate hole 56*a* in the first bracket 56, only the urging force of the first urging spring 58 is involved.

The second cam mechanism 52 comprises the following components: a second bracket 64 that rotatably supports the second nip roller 38*b* and which makes reciprocal movements in the direction in which the second nip roller 38*b* moves either toward or away from the second drive roller 38*a* (i.e., vertically in FIG. 2); a second urging spring 66 that urges the second bracket 64 in the direction in which the second nip roller 38*b* is pressed against the second drive roller 38*a* (i.e., downward in FIG. 2); a second pivoting member 68 that engages the second bracket 64 to pivot about the fixed shaft 59; and the eccentric cam 62 that engages the second pivoting member 68 to pivot it such that the second bracket 64 is moved in the direction in which the second nip roller 36*b* is retracted (i.e., upward in FIG. 2). Thus, the first cam mechanism 50 and the second cam mechanism 52 are driven by the single common eccentric cam 62, which has a cam profile that either advances or retracts the first nip roller 36*b* and the second nip roller 38*b* in synchronism with the transport of the light-sensitive material Z. The engagement between the second bracket 64 and the second pivoting member 68 is established by a prolate hole 64*a* in the second bracket 64 that is large enough to permit its reciprocal movement vertically in FIG. 2 and a pin 68*a* erected at an end of the second pivoting member 68. Thus, the second nip roller 38*b* is moved either toward or away from the second drive roller 38*a* in the same manner as the first nip roller 36*b* is moved either toward or away from the first drive roller 36*a*. Stated specifically, to move the second bracket 64 upward in FIG. 2, the eccentric cam 62 causes the second pivoting member 68 to pivot, whereupon the second bracket 64 is moved upward counteracting the urging force of the second urging spring 66. To move the second bracket 64 downward in FIG. 2, the pivoting of the second pivoting member 68 by the eccentric cam 62 cooperates with the urging by the second urging spring 66 in the initial stage of the movement but in the final stage, only the urging by the second urging spring 66 is involved.

The drive mechanism 54 comprises the following components: a drive motor 70 serving as the drive source; a transmission gear 72 having a large-diameter toothed wheel 72*a* meshing with a toothed wheel 70*b* on the drive shaft 70*a* of the drive motor 70 and a small-diameter toothed wheel 72*b* concentric with the large-diameter toothed wheel 72*a*; a wheel 62*b* that is concentric with the pivoting shaft 62*a* of the eccentric cam 62 and which meshes with the small-diameter toothed wheel 72*b* in the transmission gear 72; and a start point detecting sensor 74 that detects the initial position of the eccentric cam 62. In synchronism with the detection of the advancing end of the light-sensitive material Z by the associated sensor (not shown), the drive motor 70 rotates in either a forward or a reverse direction, whereupon the eccentric cam 62 is rotated accordingly to pivot the first and second pivoting members 60 and 68 so that the first and second brackets 56 and 64 are moved either upward or downward. In this way, the first nip roller 36*b* in the first roller pair 36 separates from or comes into contact with the first drive roller 36*a*, and the second nip roller 38*b* in the second roller pair 38 separates from or comes into contact with the second drive roller 38*a*; as a result, the light-sensitive material Z can be transported in the auxiliary scanning direction as it is nipped between rollers while ensuring that no great impact will develop when the advancing end of the light-sensitive material Z emerges from the first roller pair 36 or its trailing end goes into the second roller pair 38, thereby accomplishing so-called "soft landing" or "soft nipping" actions.

The retaining roller pair 42 and the nipping force adjusting mechanism 46 are two most characteristic parts of the present invention; they ensure that the "curly" advancing and trailing ends of the light-sensitive material Z in sheet form will not experience an upward departure from the recording position X and any positional offset that may occur to the scan exposing light beams L in the depth direction is eliminated or reduced to a very small tolerable limit; as a result, the entire area of the light-sensitive material Z in sheet form including its advancing and trailing ends can be transported in the auxiliary scanning direction while assuring a sufficient degree of flatness to enable highly precise image recording.

On the pages that follow, the retaining roller pair 42 and the nipping force adjusting mechanism 46 are described in greater detail with reference to FIGS. 2–6.

As these figures show, the nipping force adjusting mechanism 46 comprises a third rocking member 76 that rotatably supports the retainer roller 42*b*, a third urging spring 78 that urges the third rocking member 76 such that the retainer roller 42*b* is pressed against the fixed roller 42*a*, and a fourth rocking member 80 that not only fixes the other end of the third urging spring 78 but also hinges on the rocking shaft 76*a* of the third rocking member 76 and which engages the first bracket 56 in the first cam mechanism 50 to rock about the fixed rocking shaft 80*a*. In synchronism with the vertical movements of the first bracket 56 that are mediated by the pivoting of the first pivoting member 60 caused by the eccentric cam 62, the nipping force adjusting mechanism 46 adds the urging force of the third urging spring 78 to the third rocking member 76 or removes said force so that the force by which the retainer roller 42*b* is pressed against the fixed roller 42*a* is accordingly added or removed; in this way, the force by which the retainer roller pair 42 nips the light-sensitive material Z is adjusted.

Figure 3:
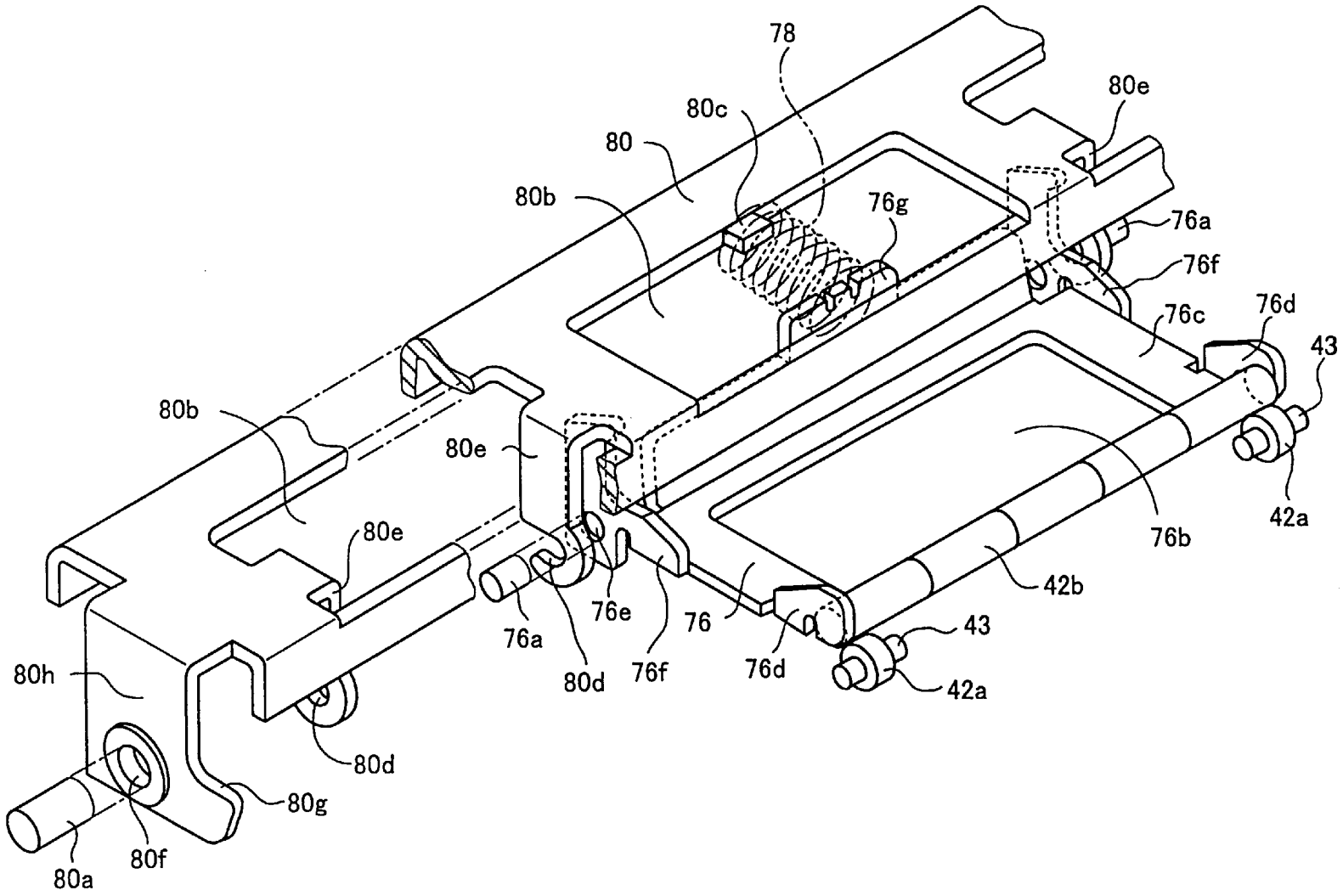
FIG. 3 is a perspective view showing in partial section the nipping force adjusting mechanism used in the auxiliary scan transport unit shown in FIG. 2.

FIG. 3 is a perspective view showing in partial section the nipping force adjusting mechanism 46 shown in FIG. 2. As shown, the fourth rocking member 80 comprises the following components: a plurality of openings 80*b* that retain several, say, five third urging springs 78 that respectively engage the corresponding number of third rocking members 76; an engaging projection 80*c* that is provided on one side of each opening 80*b* (along the length of the fourth rocking member 80) to engage one end of the third urging spring 78 retained in that opening 80*b*; a plurality of hanging lugs 80*e* that hang on the other sides of the openings 80*b* (along the shorter length of the fourth rocking member 80) and which have openings 80*d* through which the rocking shafts 76*a* of the third rocking members 76 are to be fitted; and L-shaped brackets 80*h* that hang on both shorter sides of the fourth rocking member 80 and which have bearing openings 80*f* that journal the fixed rocking shaft 80*a* and extensions 80*g* that engage the first bracket 56.

Figure 4:
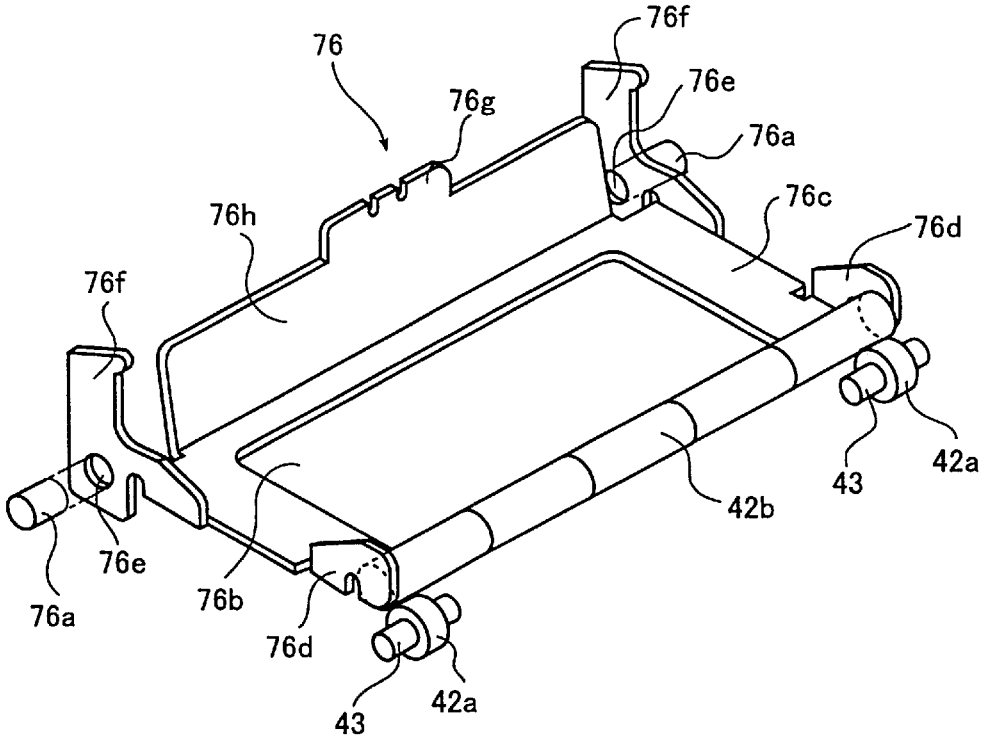
FIG. 4 is a perspective view showing the retaining roller pair and the third rocking member used in the nipping force adjusting mechanism shown in FIG. 3.

FIG. 4 is a perspective view of the retaining roller pair 42 and the third rocking member 76 that are shown in FIG. 3.

As shown in FIGS. 3 and 4, the third rocking member 76 comprises the following components: a U-shaped body 76*c* having an opening 76*b* for receiving one of the several segments of the first nip roller 36*b* in the first roller pair 36; roller supports 76*d* that are erected on the outer lateral sides of the open ends of the body 76*c* (the lower right side of FIG. 4) to rotatably support the retainer roller 42*b*; brackets 76*f* that are erected on the outer lateral sides of the rear end of the body 76*c* (the upper right side of FIG. 4) and which have bearing openings 76*e* that journal on the rocking shaft 76*a* to be fitted through the openings 80*d* in the fourth rocking member 80; and an inclined wall 76*h* that is erected at a specified angle on the rear side of the body 76*c* (the upper right side of FIG. 4) and which has an engaging ridge 76*g* that engages the other end of the third urging spring 78 on the back side away from the opening 76*b*.

As is clearly shown in FIG. 3, the third rocking member 76 is fitted to the fourth rocking member 80 from below and the engaging ridge 76*g* on the inclined wall 76*h* of the third rocking member 76 projects through one of the openings 80*b* in the fourth rocking member 80 to engage one end of the third urging spring 78 that is received in the opening 80*b* with its other end being in engagement with the engaging ridge 76*g*.

In the case shown in FIGS. 3 and 4, the retainer roller 42*b* in the retaining roller pair 42 is split into several segments (split rollers) of a smaller size and the retainer roller 42*b* for each segment is subdivided into smaller sub-segment rollers, and the fixed roller 42*a* is split into the same segments of the retainer roller 42*b* and the fixed roller 42*a* for each segment is subdivided into two subdivided rollers which are fitted on both ends of each segment of the retainer roller 42*b* supported by the two retainer roller supports 76*d* in the third rocking member 76. In FIG. 3, only one set of the third rocking member 76 and the retaining roller pair 42 is shown for the sake of simplicity but it should of course be understood that several sets of these members are provided along the entire length of the fourth rocking member 80.

Figure 5:
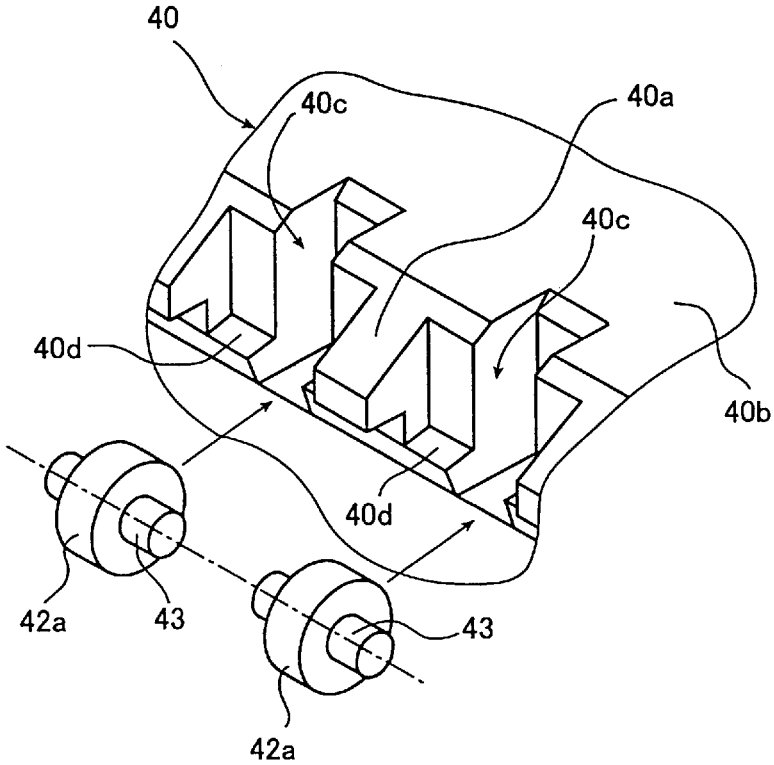
FIG. 5 is an exploded perspective view showing the spatial relationship between an optical scan guide and the fixed rollers of the retaining roller pair shown in FIG. 3.

FIG. 5 is an exploded view showing the spatial relationship between the optical scan guide 40 and the fixed roller 42*a* in the retaining roller pair 42 shown in FIG. 3. As shown, the subdivided rollers of the fixed roller 42*a* spaced apart from each other are rotatably fitted into recesses 40*c* made in the inclined portion 40*a* and the flat portion 40*b* of the optical scan guide 40. A shaft (fixing pin 43) for rotatably supporting the subdivided rollers of the fixed roller 42*a* rests on steps 40*d* in the recesses 40*c* and is fixed by means of separate members (not shown). If the subdivided rollers of the fixed roller 42*a* are thusly supported in the recesses 40*c* as if they were "buried" in the optical scan guide 40 and if the diameters of the fixed roller 42*a* and the retainer roller 42*b* are minimized, the retaining roller pair 42 can be provided in an area that is the closest possible to the recording position X. Any configuration may of course be adopted, if the fixed roller 42*a* can be rotatably fitted into the recesses 40*c* of the optical scan guide 40. For example, the fixed roller 42*a* may be integrated with the shafts to rotatably support them.

Then, the fixed roller 42, namely, the plurality of the subdivided rollers of fixed roller 42*a* that are spaced apart from each other are preferably provided so that the a back print position or back print positions are avoided to prevent transfer of back printing on the light-sensitive material Z with the back printer 30 shown in FIG. 1.

As a result, the back side (opposite the emulsion-coated side) of the light-sensitive material Z being transported in the auxiliary scanning direction is supported by the subdivided rollers of the fixed roller 42*a* at specified intervals and while the light-sensitive material Z is between the segments, its back side is supported by the inclined portion of the optical scan guide 40. On the other hand, the emulsion-coated side of the light-sensitive material Z is pressed down under the segments of retainer roller 42*b* over the entire length along the main scanning line near the recording position X. This is effective in preventing almost all positional offsets that conventionally occur in the depth direction, as exemplified by a curl-induced upward departure from the recording position X.

In the present invention, the dimensions (e.g., diameter and length), shape, constituent material and other factors of the fixed roller 42*a* and the retainer roller 42*b* are by no means limiting, except that in the case of the illustrated recording apparatus 10, the retainer roller 42*b* makes direct contact with the emulsion-coated surface of the light-sensitive material Z and, hence, must be made of materials that are inert to that surface. In short, the dimensions (e.g., diameter and length), shape, constituent material and other factors of the fixed roller 42*a* and the retainer roller 42*b* may be selected as appropriate for the sheeting used and its application.

In the illustrated case, the mechanism 46 for adjusting the nipping force exerted by the retaining roller pair 42 is driven in synchronism with the vertical movements of the first bracket 56 in the first cam mechanism 50 in the opening and closing mechanism 44 for actuating the soft nipping of the light-sensitive material Z by means of the two transport roller pairs 36 and 38 in the auxiliary scan transport unit 16.

Figure 6A:
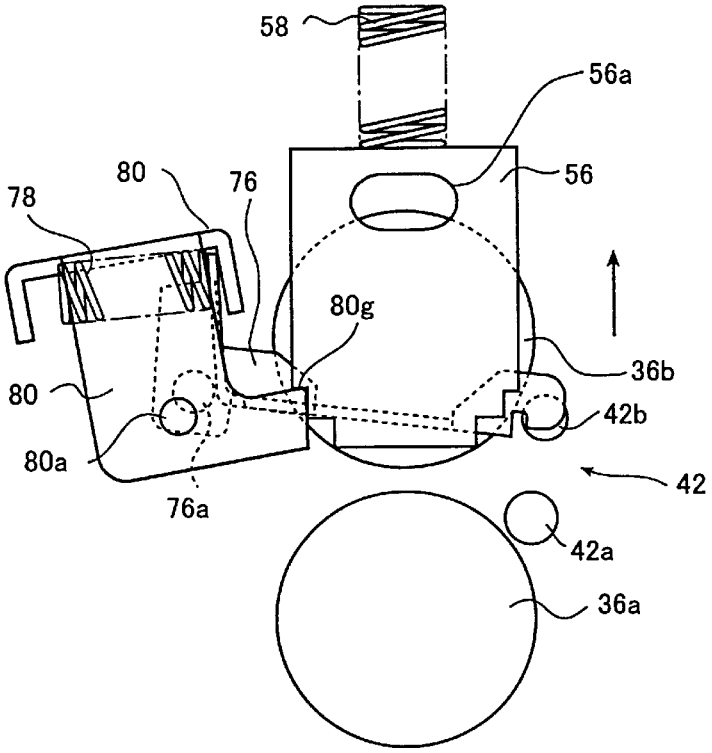
FIGS. 6A and 6B are diagrammatic partial side views showing how the first bracket in the auxiliary scan transport unit shown in FIG. 2 helps the fourth rocking member to add or relieve the urging force by which the third rocking member is urged.
Figure 6B:
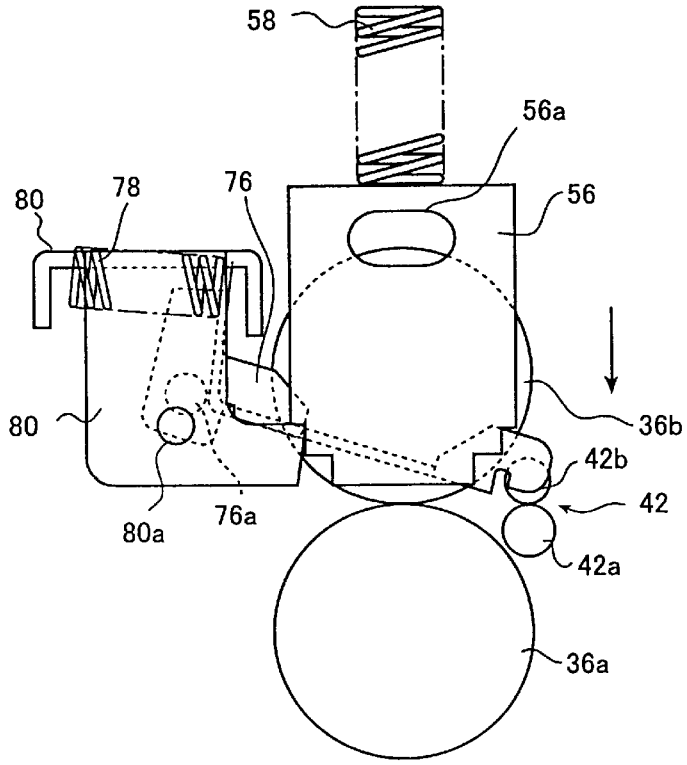
Figure 7A:
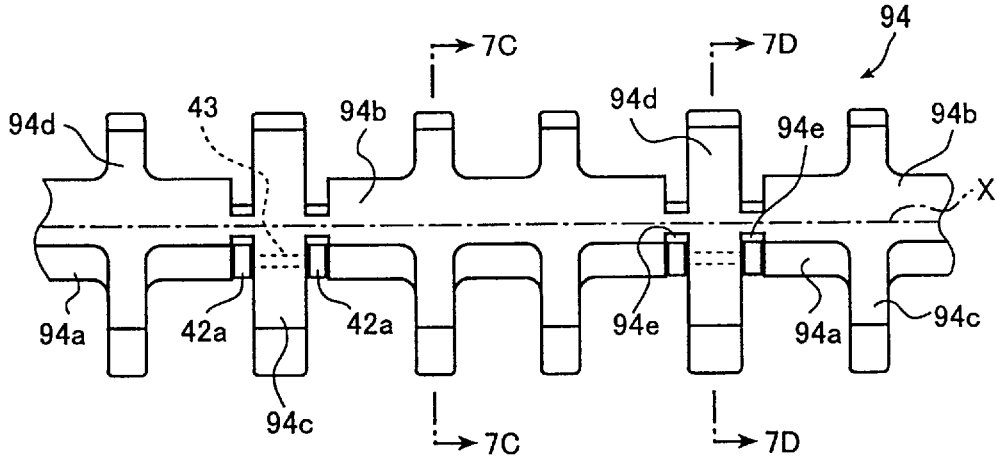
FIGS. 7A, 7B, 7C and 7D are a plan view, a front view, a cross sectional view in 7C—7C line of FIG. 7A and a cross sectional view in 7D—7D line of FIG. 7A, respectively which show schematically another state of fixing of the fixed rollers in the retaining roller pair shown in FIG. 3 to the optical scan guide.
Figure 7B:
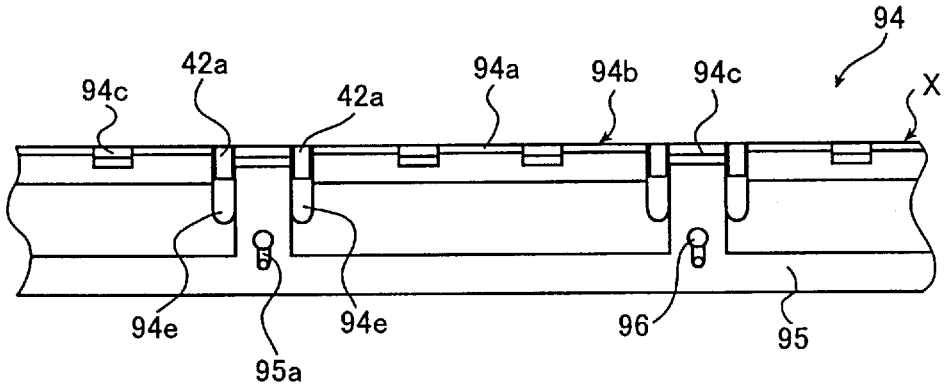
Figure 7C:
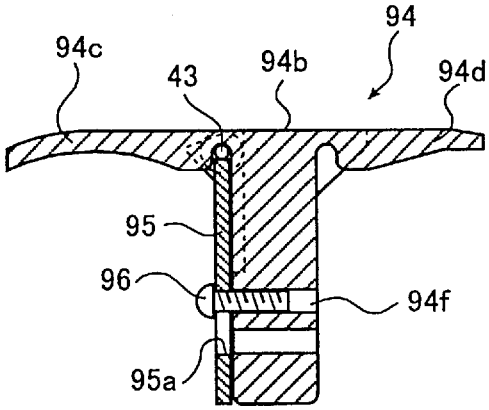
Figure 7D:
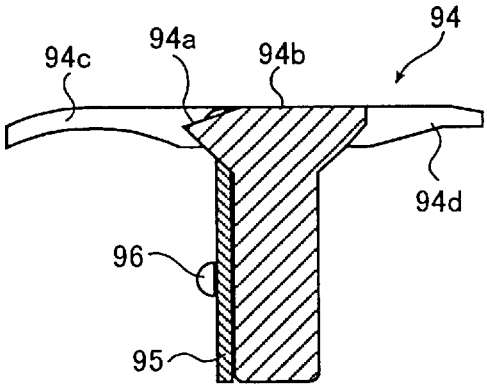

FIGS. 6A and 6B are diagrammatic partial side views showing how the first bracket 56 actuates the fourth rocking member 80 to urge the third rocking member 76.

By referring to FIGS. 2 and 6, we now describe the soft nipping of the light-sensitive material Z by the two transport roller pairs 36 and 38 as initiated by the opening and closing mechanism 44 and the synchronous process by which the force exerted by the retaining roller pair 42 to nip the light-sensitive material Z is adjusted by the nipping force adjusting mechanism 46.

First, prior to the start of recording with the recording apparatus 10, the drive motor 70 in the drive mechanism 54 for the opening and closing mechanism 44 is driven and the eccentric cam 62 is set to the initial position detected by the start point detecting sensor 74. On this occasion, the two transport roller pairs 36 and 38 and the retaining roller pair 42 in the auxiliary scan transport unit 16 are both closed to become urged as shown in FIG. 2 and individual members of the opening and closing mechanism 44 and the nipping force adjusting mechanism 46 are also in the state shown in FIG. 2. To be more specific, the extensions 80*g* of the fourth rocking member 80 in the nipping force adjusting mechanism 46 engage the first bracket 56 in the first cam mechanism 50 to be urged downward by means of the first urging spring 58, whereupon the third urging spring 78 supported on the fourth rocking member 80 urges the third rocking member 76 to press the retainer roller 42*b* against the fixed roller 42*a* in the retaining roller pair 42.

Thereafter, the advancing end detecting sensor (not shown) detects the advancing end of the light-sensitive material Z having reached a specified position upstream of the first roller pair 36 in the auxiliary scan transport unit 16, whereupon the number of rotations of the first and second roller pairs 36 and 38 being driven synchronously by a synchronous drive unit (not shown) and, hence, the distance of transport of the light-sensitive material Z starts to be counted. If the light-sensitive material Z is at the first of a sequence of steps in the recording process, the output of the sensor for detecting the advancing end of the light-sensitive material Z is used as the reference and the drive motor 70 in the drive mechanism 54 rotates counterclockwise (as seen in FIG. 2) by a specified amount, causing the eccentric cam 62 to rotate counterclockwise by a specified amount so that the second pivoting member 68 pivots counterclockwise to move the second bracket 64 upward, whereupon the second nip roller 38*b* is brought to the initial state, i.e., moved away from the second drive roller 38*a*.

When a specified distance of transport has been counted, the advancing end of the light-sensitive material Z counteracts the urging force on the first roller pair 36 to go into the space between the first drive roller 36*a* and the nip roller 36*b* so that it is nipped between these two rollers; as a result, the light-sensitive material Z is transported downstream as it is driven synchronously with the rotating first drive roller 36*a*. If the light-sensitive material Z is transported further downstream, its advancing end counteracts the urging force on the retaining roller pair 42 to go into the space between the fixed roller 42*a* and the retainer roller 42*b*. If the light-sensitive material Z is transported further downstream until its advancing end reaches the recording position X, the light beams L issuing from the exposing unit 34 start scan exposure of the light-sensitive material Z. On this occasion, the advancing end of the light-sensitive material Z which is just upstream of the recording position X is pressed over the entire length along the main scanning line against the fixed roller 42*a* by means of the retainer roller 42*b* in the retaining roller pair 42 and against the inclined portion 40*a* of the optical scan guide 40 which is near the flat portion 40*b*. Therefore, even if the advancing end of the light-sensitive material Z curls, it will not depart upward from the recording position X and can remain adequately flat, thereby allowing its scan exposure to be performed with sufficient precision to record an image of high-quality.

This highly precise scan exposure is successively performed on the light-sensitive material Z as its transport in the auxiliary scanning direction continues.

When the light-sensitive material Z has been transported for a specified distance after the start of its highly precise scan exposure, its advancing end approaches the second roller pair 38 which has opened wide enough to accept its entry between the second nip roller 38*b* and the second drive roller 38*a*. In synchronism with this event, the drive motor 70 rotates in a reverse direction (clockwise as seen in FIG. 2) and the second pivoting member 68 pivots in the reverse direction; this pivotal action combines with the urging force of the second urging spring 66 to move the second bracket 64 downward. When the advancing end of the transported light-sensitive material Z has exceeded the nip point of the second roller pair 38, the second nip roller 38*b* is urged toward the second drive roller 38*a* so that the light-sensitive material Z is nipped positively. On this occasion, the first nip roller 36*b* which is driven to rotate by the first drive roller 36*a* which is driven synchronously with the second drive roller 38*a* causes the second nip roller 38*b* to rotate synchronously since the two rollers are coupled together with the timing belt 37. As a result, the light-sensitive material Z coming into contact with the second nip roller 38*b* receives such a small amount of impact that it can be softly nipped by the second roller pair 38 without producing any positional offsets and other unwanted effects.

Thus, the eccentric cam 62 returns to the start position, the second roller pair 38 is closed and brought to the state shown in FIG. 2, which is also the case for the second cam mechanism 52.

As the light-sensitive material Z is further transported with scan exposure, its trailing end approaches the first roller pair 36 and is detected by the already mentioned advancing end detecting sensor (not shown). Then, the drive motor 70 in the drive mechanism 54 rotates counterclockwise (as seen in FIG. 2) by a specified amount, causing the eccentric cam 62 to rotate counterclockwise by a specified amount so that the first pivoting member 60 pivots counterclockwise to move the first bracket 56 upward; then, in synchronism with the release of the trailing end of the light-sensitive material Z from the first roller pair 36, the first nip roller 36*b* moves away from the first drive roller 36*a* to relieve the nipping of the light-sensitive material Z by the first roller pair 36. When the light-sensitive material Z is ejected from the first roller pair 36, it has already been released from the nipping action of the latter and there will be no impact, positional offset or other undesirable effects that would otherwise occur if the trailing end of the light-sensitive material Z were forced to emerge from the closed first roller pair 36. Instead, the light-sensitive material Z can be softly released and ejected from the first roller pair 36.

Thereafter, the light-sensitive material Z is transported further downstream with scan exposure and its trailing end approaches the retaining roller pair 42.

On this occasion, as FIG. 6A shows, the first bracket 56 moves upward to cause an ascending movement of the engaging extension 80*g* of the fourth rocking member 80 in the nipping force adjusting mechanism 46, which then pivots counter-clockwise about the fixed rocking shaft 80*a* and, in synchronism with the release of the trailing end of the light-sensitive material Z from the retaining roller pair 42, the engaging ridge 76*g* on the inclined portion 76*h* of the third rocking member 76 comes into contact with a lateral side of the fourth rocking member 80. This action relieves the force of urging exerted on the third rocking member 76 by the third urging spring 78 provided between the engaging ridge 76*g* on the inclined portion 76*h* of the third rocking member 76 and the engaging lug 80*c* overhanging the opening 80*b* in the fourth rocking member 80. As a result, the third rocking member 76 becomes free to pivot about the rocking shaft 76*a* and the force of urging the retainer roller 42*b* of the retaining roller pair 42 on the fixed roller 42*a*, namely, the force by which the light-sensitive material Z on the fixed roller 42*a* is pressed down, is removed and the retainer roller 42*b* does not press down the light-sensitive material Z on the fixed roller 42*a*. It should be noted here that the retainer roller 42*b* may push the light-sensitive material Z on the fixed roller 42*a* down under its own weight, or be completely separated from the light-sensitive material Z on the fixed roller 42*a* not so as to apply its own weight. Thus, the light-sensitive material Z is released and ejected from the retaining roller pair 42. In this case, too, the light-sensitive material Z has already been released from the nipping action of the retaining roller pair 42 and there will be no impact, positional offset or other undesirable effects that would otherwise occur if the trailing end of the light-sensitive material Z were forced to emerge from the closed retaining roller pair 42. Instead, the light-sensitive material Z can be softly released and ejected from the retaining roller pair 42.

Thereafter, the light-sensitive material Z is transported further downstream. When its trailing end has exceeded the recording position X, the issuing of light beams from the exposing unit 34 ceases and the scan exposure of the light-sensitive material Z ends. Even after the end of its scan exposure, the light-sensitive material Z continues to be transported downstream by the second roller pair 38. In synchronism with this action, the drive motor 70 rotates in a reverse direction (counterclockwise as seen in FIG. 6A) by a specified amount and the resulting reverse pivoting of the first pivoting member 60 cooperates with the urging force of the first urging spring 58 to move the first bracket 56 downward, whereupon the first nip roller 36*b* contacts the first drive roller 36*a* to urge it. As shown in FIG. 6B, the downward movement of the first bracket 56 causes the fourth rocking member 80 to pivot clockwise and the urging force of the third urging spring 58 gives an impetus for pivoting the third rocking member 76 clockwise so that the retainer roller 42*b* in the retaining roller pair 42 contacts the fixed roller 42*a* to urge them. Thus, the eccentric cam 62 returns to the initial position and the first roller pair 36 and the retaining roller pair 42 are both closed and brought to the state shown in FIG. 2, which is also the case for the first cam mechanism 50.

Thereafter, the light-sensitive material Z is transported further downstream. When it is ejected from the second roller pair 38, the drive motor 70 in the drive mechanism 54 immediately rotates counterclockwise by a specified amount and the eccentric cam 62 also rotates counterclockwise by a specified amount to pivot the second pivoting member 68 counterclockwise, whereupon the second bracket 64 is moved upward and the second nip roller 38b moves away from the second drive roller 38*a* to return to its initial state. Thus, all components in the auxiliary scan transport unit 16 including the first and second roller pairs 36 and 38 and the first and second cam mechanisms 50 and 52 return to the initial state.

Described above is the sequence of steps in the process of auxiliary scan transport by the unit 16 using the sheeting transport apparatus of the present invention.

In the illustrated case, the combination of the timing belt 37 and pulleys is used for causing the nip rollers 36*a* and 38*a* in the transport roller pairs 36 and 38 to rotate synchronously with the drive rollers 36*b* and 38*b* even if the two rollers in at least one of those transport roller pairs are spaced apart. However, this is not the sole example that can be used and any devices may be used if they are capable of synchronous rotation of the nip rollers 36*a* and 38*a*; to name just a few, these nip rollers may be coupled together by the combination of a chain and a sprocket or by means of idlers or wheels.

Thus, even if the advancing end of the light-sensitive material Z that is nipped only by the upstream first roller pair 36 during transport or its trailing end that is nipped only by the downstream second roller pair 38 during transport has any surface defect such as a curl, the retaining roller pair 42 at a site upstream of and very close to the recording position X on the optical scan guide 40 effectively eliminates any curl or otherwise induced upward departure and other positional offsets in the depth direction and enables the light-sensitive material Z to be always held flat in the correct recording position X. As a result, precise scan exposure can be accomplished with the light beams L from the exposing unit 34 to produce images of high quality.

Conventionally, load variations are inevitable when the advancing end of the light-sensitive material Z goes into the downstream second roller pair 38 and when its trailing end emerges from the upstream first roller pair 36 and the retaining roller pair 42. This problem can be solved by the present invention if it adopts the following process: both rollers in whichever of the transport roller pairs 38 and 36 that lies in the position corresponding to the advancing or trailing end of the light-sensitive material Z are rotated synchronously as they are moved away from each other to relieve the nipping of the light-sensitive material Z; then, the two rollers are brought into contact with each other to nip the light-sensitive material Z; subsequently, the urging force exerted by the two rollers in the retaining roller pair 42 is removed to relieve the nipping of the light-sensitive material Z; finally, the urging force is added to nip the light-sensitive material Z. Since the load variations can be prevented, any offsets in the exposing position and any unevenness in exposure that would otherwise result from such load variations can be effectively prevented to produce images of an even better quality.

It should be noted that the sequence of steps in the process of opening and closing the first and second roller pairs 36 and 38 and that of steps in the process of adjusting the nipping force of the retaining roller pair 42 are by no means limited to the examples described above but may be realized in various other ways. To name several examples, the first roller pair 36 may be opened and closed at the time when the advancing end of the light-sensitive material Z passes through it; the urging force of the retaining roller pair 42 may be adjusted when the advancing end passes through it; the second roller pair 38 may be opened and closed when the trailing end of the light-sensitive material Z passes through it; if the load variations that result from the passage of the advancing and trailing ends of the light-sensitive material Z are believed to cause only small effects on the image to be recorded, the first and second roller pairs 36 and 38 may preliminarily be brought into contact with each other so that the light-sensitive material Z is nipped until after its trailing end has been released.

After being thusly subjected to precise scan exposure, the light-sensitive material Z is ejected from the auxiliary scan transport unit 16 and fed into the distributing unit 20 in a downstream position. The distributing unit 20 distributes individual sheets of the light-sensitive material Z sidewise or in a lateral direction perpendicular to the direction of their transport (hence, their transport through the developing machine 92) to form a plurality of rows.

With common silver salt photographic materials which are currently used in printing photographs, development processing is more time-consuming than exposure and if exposure is performed continuously, development processing cannot keep pace with the exposure but lags behind it.

The distributing unit 20 is provided with a view to eliminating this difficulty and by distributing individual sheets of the light-sensitive material Z sidewise to form a plurality of rows that overlap in the direction of transport, the throughput of the developing machine can be improved (almost doubled in two rows and tripled in three rows) and the time difference between development processing and exposure is practically cancelled.

The distributing unit 20 may adopt various sheet distributing methods, as exemplified by a method using a turret which rotates about a shaft and a method in which the unit of transporting the light-sensitive material Z is divided into a plurality of blocks, say, three blocks and the center block is moved sidewise. In another applicable method, belt conveyors as a transport device which carry the individual sheets of light-sensitive material Z and transport them downstream are combined with a lift transport device that lifts the sheets of light-sensitive material Z using suckers or the like and transports them sidewise so that they are distributed in a plurality of rows. When the sheets of light-sensitive material Z as carried by the belt conveyors have been transported to a specified downstream position, the lift transport device turns on to lift the sheets and transports them either sidewise or obliquely (downstream) so that they are distributed in a plurality of rows.

After being optionally distributed into the required number of rows by the distributing unit 20, the sheets of light-sensitive material Z are transported by a transport roller pair 90 into the developing machine 92, where they are subjected to the various treatments required by the light-sensitive material Z such as development, fixing and rinsing; thereafter, the processed sheets are dried to yield prints.

While the basic construction of the recording apparatus 10 which applies the sheeting transport apparatus of the invention as the auxiliary scan transport unit 16 has been described on the foregoing pages, it should be stressed that the illustrated embodiment is not the sole case that can be adopted in the invention. For example, the device of ensuring that the light beams L from the recording position X in the auxiliary scan transport unit 16 will not be positionally offset in the depth direction at a site upstream of and close to the recording position X is not limited to the illustrated combination of the retaining roller pair 42 and the associated nipping force adjusting mechanism 46. This may be replaced by any type of device that can press down the light-sensitive material Z and relieve the pressure at appropriate times as it is transported into the optical scan guide 40. If desired, the optical scan guide 40 may be omitted if the anti-positional offset mechanism such as the retaining roller pair 42 and the nipping force adjusting mechanism 46 are capable of defining the recording position X.

In the above embodiment, as shown in FIGS. 1 and 2, the retaining roller pair 42 used as the mechanism for preventing positional offsets of the sheeting including the light-sensitive material Z that may occur in the depth direction from the recording position (optical scan position) X is provided upstream of the recording position X to prevent upward departure of the light-sensitive material Z near the recording position X on the upstream side to thereby protect it from any positional offset from the recording position X that may occur in the depth direction of the light beams L. This is not the sole case of the invention, and the retaining roller pair 42 or another anti-positional offset mechanism may be provided downstream or both downstream and upstream of the recording position X. However, the retaining roller pair 42 or another anti-positional offset mechanism may be preferably provided upstream thereof, because concern about jamming or other inconveniences is reduced and unevenness in image recording does not readily occur. If the retaining roller pair 42 is provided downstream, the curly advancing end of the sheet of light-sensitive material Z easily strikes it, whereas if it is provided upstream, the guide protects the sheet until it reaches the recording position X, thereby reducing the concern about jamming. Unevenness is likely to occur at the point of time when the retaining roller pair 42 nips or releases the sheet of light-sensitive material Z. The sensitivity to unevenness is lower upon release than upon nipping. Then, unevenness is less recognized visually when the retaining roller pair 42 is provided upstream than when it is provided downstream.

In the above embodiment, as shown in FIGS. 2 and 5, the subdivided rollers of the fixed roller 42*a* of the retaining roller pair 42 are respectively rotatably fitted into the recesses 40*c* formed in the optical scan guide 40 having the inclined portion 40*a* and the flat portion 40*b*. However, this is not the sole case of the invention, and the fixed roller 42*a* may be rotatably fitted into an optical scan guide 94 as shown in FIGS. 7A, 7B, 7C and 7D, instead of the optical scan guide 40.

The illustrated optical scan guide 94 has an inclined portion 94*a*, a flat portion 94*b*, curved pawls 94*c* in a comb shape which extend upstream from the flat portion 94*b* and of which the forward end is curved downward, straight pawls 94*d* in a comb shape which extend straight downstream from the flat portion 94*b*, and a plurality of recesses 94*e* into which the subdivided rollers of the fixed roller 42*a* are rotatably fitted.

The inclined portion 94*a* and the flat portion 94*b* of the optical scan guide 94 have substantially the same shapes as the inclined portion 40*a* and the flat portion 40*b* of the optical scan guide 40. The flat portion 94*b* is used to receive the light-sensitive material Z correctly in the recording position X and to define in this recording position X the main scanning line drawn by the recording light beams L emitted from the exposing unit 34 onto the light-sensitive material Z. The central portion of the flat portion 94*b* has the recording position X that forms the main scanning line along the main scanning direction.

The plurality of curved pawls 94*c* formed in the comb shape extend upstream on an approximately identical plane from the flat portion 94*b* to the point in which the first roller pair 36 of the auxiliary scan transport unit 16 shown in FIG.

2 nips the sheet (the point in which the drive roller 36*a* comes in contact with the nip roller 36*b*), and after exceeding the nipping point, the curved pawls 94*c* extends further upstream while being curved downward. In the illustrated case, the straight pawls 94*d* of which the trailing (or advancing end) is chamfered are formed in the comb shape and extend downstream from the flat portion 94*b* on an approximately identical plane so as to correspond to the plurality of curved pawls 94*c*.

The recesses 94*e* are formed on both sides of the curved pawls 94*c*. The curved pawls 94*c* into which the subdivided rollers of the fixed roller 42*a* are to be fitted and the corresponding straight pawls 94*d* are formed to have larger widths than the other curved pawls 94*c* and straight pawls 94*d* that do not receive the subdivided rollers of the fixed roller 42*a*.

Any steps between the flat portion 94*b* (plane defining the recording position X) of the optical scan guide 94 light-sensitive material Z and the point in which the light-sensitive material Z is nipped between the first roller pair 36 (top of the drive roller 36*a*), or between the flat portion 94*b* of the optical scan guide 94 and the nipping point of the first roller pair 38 (top of the drive roller 36*a*) may cause unevenness in image recording.

Therefore, the flat portion 94*b* of the optical scan guide 94 is designed to have a height identical to or slightly lower than that of nipping point of the first roller pair 36 and that of the nipping point of the second roller pair 38, as sell as is provided with the curved pawls 94*c* and straight pawls 94*d* in the comb shape. By designing and providing the optical scan guide 94 as described above, the curved pawls 94*c* of the optical scan guide 94 receive smoothly the light-sensitive material Z in the nipping point of the first roller pair 36, guide it to the same height as the flat portion 94*b* by means of the forward curved portion thereof, slide it as such on the flat portion 94*b* defining the recording position X without changing the height, and finally guide it up to the nipping point of the second roller pair 38. Hence, shift of the light-sensitive material Z in the recording position X does not occur due to the steps, and occurrence of the unevenness in image recording can be prevented.

The recesses 94*e* are provided on both sides of the wide curved pawls 94*c* having a specified width on the base of the optical scan guide 94 and used to rotatably fit the subdivided rollers of the fixed roller 42*a* thereinto. One of the recesses 94*e* receives the subdivided roller of the fixed roller 42*a* located in one end of the segment of the retainer roller 42*b* shown in FIG. 3, and the other receives the subdivided roller of the fixed roller 42*a* located in the other end of the neighboring segment of the retainer roller 42*b*. In the embodiment shown in FIGS. 3–5, each of the subdivided rollers of fixed roller 42*a* is rotatably supported by the fixing pin 43 fixed in the steps 40*d* in the recesses 40*c* of the optical scan guide 40. In the embodiment shown in FIGS. 7A–7D however, a pair of the subdivided rollers of the fixed roller 42*a* which are respectively fitted into a pair of the recesses 94*e* formed on both sides of the curved pawl 94*c* are supported so that they can rotate in both ends of the fixing pin 43 fixed on the reverse side of the curved pawl 94*c* of the optical scan guide 94. The fixing pin 43 is provided on the reverse side of the curved pawl 94*c* of the optical scan guide 94, and is fixed in a cavity communicating a pair of the recesses 94*e* by means of a fixing member 95. The fixing member 95 is screwed on the optical scan guide 94 by inserting a screw 96 through a prolate hole 95*a* into a female screw 94*f* provided in the optical scan guide 94. The fixing member 95 is an integrated member so that a plurality of the fixing pins 43 can be fixed simultaneously. However, the fixing pins 43 may be individually fixed to the optical scan guide 40. Further, one subdivided roller of the fixed roller 42*a* is rotatably supported by one fixing pin 43. However, each of the subdivided rollers of the fixed roller 42*a* may be supported by one fixing pin 43, or the shaft may be rotatably supported after one subdivided roller or the subdivided rollers of the fixed roller 42*a* is fixed thereto.

In the illustrated auxiliary scan transport unit 16, the first and second cam mechanisms 50 and 52 in the opening and closing mechanism 44 for opening or closing the first and second roller pairs 36 and 38 have the common eccentric cam 62, which is driven by the drive mechanism 54 having one drive motor 70. However, this is not the sole example of the invention and the first and second cam mechanisms 50 and 52 may be adapted to have individual cam members of specified cam profiles which are driven by a single drive source. Alternatively, the individual cam members may be driven by independent drive sources.

In the illustrated case, the first and second cam mechanisms 50 and 52 are so adapted that the brackets which rotatably support the nip rollers in the respective roller pairs are moved up and down by the pivoting members. However, this is not the sole case of the invention and rocking members which are integral combinations of the brackets and pivoting members may be used to ensure that the rotatable support of the nip rollers is accomplished simultaneously with their vertical movements. In the illustrated opening and closing mechanism 44, the first pivoting member 60 in the first cam mechanism 50 and the second pivoting member 68 in the second cam mechanism 52 pivot about the common fixed shaft 59. If desired, they may be adapted to rotate about different axes.

In the illustrated case which uses the combination of the retaining roller pair 42 as the anti-positional offset mechanism for preventing positional offsets in the depth direction and the associated nipping force adjusting mechanism 46, the nipping force adjusting mechanism 46 is adapted to be driven by the vertical movements of the bracket 56 in the first cam mechanism 50 in the opening and closing mechanism 44. However, this is not the sole case of the invention and the nipping force adjusting mechanism 46 may be driven by other members or a drive source that is independent of the opening and closing mechanism 44. In the illustrated case, the nipping force adjusting mechanism 46 associated with the retaining roller pair 42 is adapted to be such that the retainer roller 42*b* in the retaining roller pair 42 is rotatably supported by the third rocking member 76 which, in turn, is swingably supported by the fourth rocking member 80. However, this is not the sole case of the invention and the retainer roller 42*b* may be rotatably supported and allowed to swing by a single rocking member whereas the nipping force of the retaining roller pair 42 is adjusted in timed relationship with the opening or closing of the first roller pair 36 by the first cam mechanism 50, using the first bracket 56, the first pivoting member 60, a rocking member consisting of the combination of these two members, or an entirely different member or drive source.

Further, in the above-mentioned embodiment shown in FIGS. 2, 6A and 6B, the opening and closing mechanism 44 for opening or closing two roller pairs or the first and second transport roller pairs 36 and 38 comprises the first and second cam mechanisms 50, 52 and the drive mechanism 54. However, this is not the sole case of the invention, and any mechanism, device or method can be adopted as exemplified by a mechanism using a solenoid, a rack-and-pinion mechanism (and drive unit thereof), a linear guide mechanism (and drive unit thereof), and a mechanism using a rotary solenoid, if the two transport roller pairs 36, 38 can be opened or closed in concordance with the entry and ejection of the sheet of light-sensitive material Z.

FIGS. 8A–12 show typical examples in which the mechanisms described above are actuated to move the transport roller 36*b* of the first transport roller pair 36 in the contact and separate direction, in the illustrated case generally in a vertical direction so that it comes in contact with or goes away from the drive roller 36*a*. Reference is made to these drawings to give the following description. It should be however noted that these mechanisms are of course applicable not only when moving the drive roller 36*a* or the drive roller 36*a* and the transport roller 36*b* of the first transport roller pair 36, but also when moving at least one of the drive roller 38*a* and the transport roller 38*b* of the second transport roller pair 38.

Figures 8A, 8B:
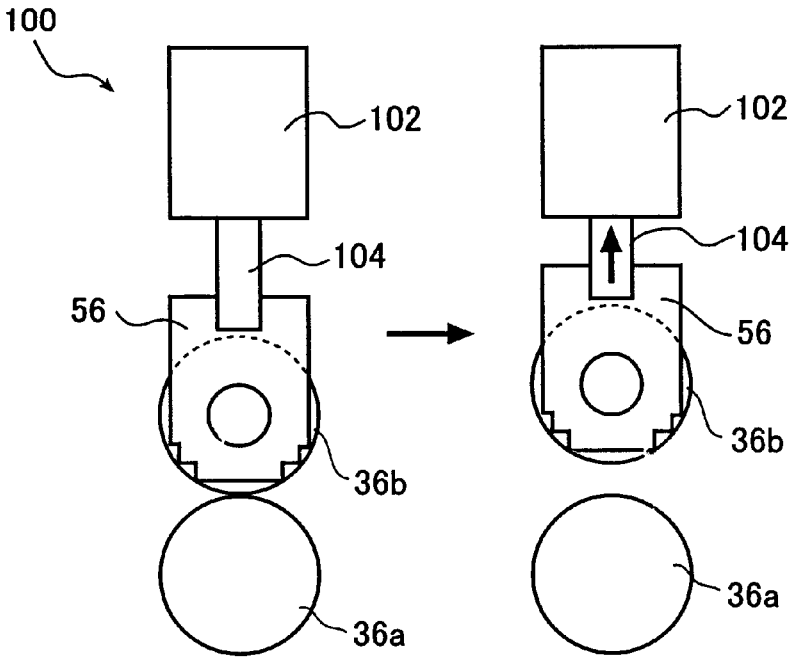
FIGS. 8A and 8B are diagrammatic partial side views that show respectively how another example of the drive system of the opening and closing mechanism for opening or closing the first roller pair shown in FIG. 2 functions.
Figure 9:
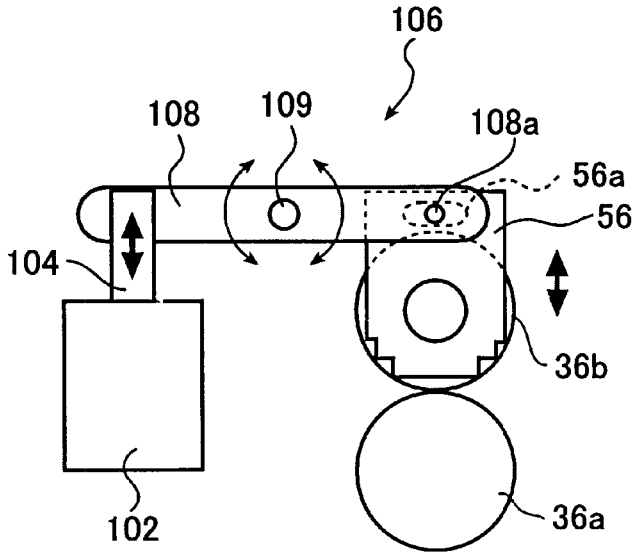
FIG. 9 is a diagrammatic partial side view that shows how still another example of the drive system of the opening and closing mechanism for opening or closing the first roller pair shown in FIG. 2 functions.

The mechanism using solenoid (electromagnetic actuator) 100 shown in FIGS. 8A and 8B comprises a solenoid 102 and a movable rod 104 of the solenoid 102 that is directly connected to the first bracket 56 rotatably supporting the transport roller 36*b* of the transport roller pair 36 in the opening and closing mechanism 44. As shown in FIG. 8A, the first bracket 56 can be urged in non-energized state by an urging device (not shown), for example by the spring 58 shown in FIG. 2 to make the transport roller 36*b* of the transport roller pair 36 come in contact with the drive roller 36*a*. On the other hand, as shown in FIG. 8B, when the solenoid 102 is energized, electromagnetic force acts on the movable rod 104 that is elevated by a specified distance against the force of urging the first bracket 56 with the spring 58, whereby the first bracket 56 engaging the movable rod 104 is also elevated. Thus, the transport roller 36*b* of the transport roller pair 36 can be separated from the drive roller 36*a* to provide a space between the two rollers 36*a* and 36*b*.

It should be noted that the mechanism 100 may be adapted so that the first bracket 56 is urged in the direction in which the transport roller 36*b* is separated from the drive roller 36*a* to provide a space between the two rollers 36*a*, 36*b* in non-energized state and to make the transport roller 36*b* come in contact with the drive roller 36*a* in energized state. Further, when the solenoid 102 itself is urged in one of upward/downward directions, a device for urging the first bracket 56 may be omitted.

In the mechanism using solenoid 100 shown in FIGS. 8A and 8B, the first bracket 56 is directly moved in a vertical direction. However, as in a mechanism using solenoid (electromagnetic actuator) 106 shown in FIG. 9, the first bracket 56 may be moved vertically via a rocking member 108. In the mechanism 106 shown in FIG. 9, the rocking member 108 has a fulcrum 109 on the central side thereof. An end of the movable rod 104 of the solenoid 102 engages one end of the rocking member 108, and the other end thereof with respect to the fulcrum 109 has a pin 108*a* that engages the prolate hole 56*a* of the first bracket 56. In this mechanism 106, the solenoid 102 is energized or not to move the movable rod 104 upward or downward, thereby rocking the rocking member 108 about the fulcrum 109. Thus, the first bracket 56 can be moved vertically to be able to contact or separate the transport roller 36*b* of the first transport roller pair 36 with or from the drive roller 36*a*.

Figure 10:
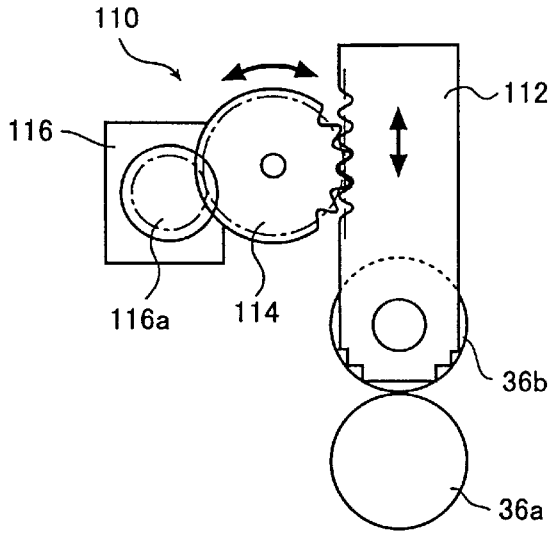
FIG. 10 is a diagrammatic partial side view that shows how yet another example of the drive system of the opening and closing mechanism for opening or closing the first roller pair shown in FIG. 2 functions.

Further, a rack-and-pinion mechanism 110 shown in FIG. 10 is used instead of the first bracket 56 shown in FIGS. 2, 6A and 6B. This mechanism 110 rotatably supports the transport roller 36*b* of the first transport roller pair 36, and comprises a rack bracket 112 having teeth on one side thereof and a pinion 114 that meshes with the teeth of the rack bracket 112. The mechanism 110 is driven by a drive unit comprising a gear 116*a* that meshes with the pinion 114 and a drive motor 116 that drives the gear 116*a*. In this mechanism 110, the drive motor 116 rotates in either a clockwise (forward) or a counterclockwise (reverse) direction, whereupon the gear 116*a* is rotated in a forward or reverse direction, and the pinion 114 meshing with the gear 116*a* is accordingly rotated in a reverse or forward direction. Then, the rack bracket 112 meshing with the pinion 114 moves vertically to be thereby able to contact or separate the transport roller 36*b* of the first transport roller pair 36 with or from the drive roller 36*a*.

Figure 11:
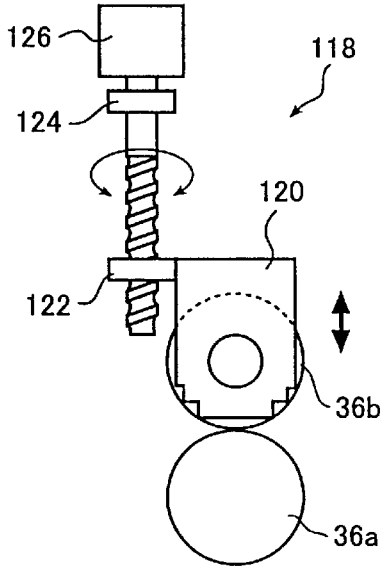
FIG. 11 is a diagrammatic partial side view that shows how a further example of the drive system of the opening and closing mechanism for opening or closing the first roller pair shown in FIG. 2 functions.

A linear guide mechanism 118 shown in FIG. 11 is used instead of the first bracket 56 shown in FIGS. 2, 6A and 6B. This mechanism 118 comprises a travelling nut 122 fixed in one end of a bracket 120 rotatably supporting the transport roller 36*b* of the first transport roller pair 36, and a drive screw 124 fitted into an internal thread of the travelling nut 122. This mechanism 118 is fixed to one end (upper end) of the drive screw 124 and driven by a drive unit that comprises a drive motor 126 rotating the drive screw 124. In this mechanism 118, the drive motor 126 rotates in either a clockwise (forward) or a counterclockwise (reverse) direction, whereupon the drive screw 124 directly connected to the rotating shaft is rotated in a forward or reverse direction and the travelling nut 122 into which the drive screw 124 is fitted moves vertically to thereby move the bracket 120 vertically. Thus, the transport roller 36*b* of the first transport roller pair 36 can be contacted with or separated from the drive roller 36*a*.

Figure 12:
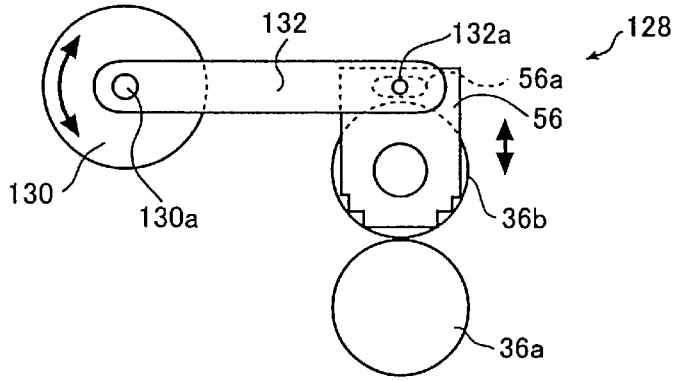
FIG. 12 is a diagrammatic partial side view that shows how a still further example of the drive system of the opening and closing mechanism for opening or closing the first roller pair shown in FIG. 2 functions.

A mechanism using rotary solenoid (electromagnetic actuator) 128 shown in FIG. 12 comprises a rotary solenoid 130 and a rocking member 132 of which one end is fixed to a rotating shaft 130*a* of the rotary solenoid 130 and of which the other end has a pin 132*a* engaging the prolate hole 56*a* of the first bracket 56. One end of the rocking member 132 is directly fixed to the rotating shaft 130*a* so that the rocking member 132 can pivot about the rotating shaft 130*a* of the rotary solenoid 130. In this mechanism 128, the rotary solenoid 130 is energized or not to pivot the rotating shaft 130*a* to thereby directly pivot the rocking member 132 about the rotating shaft 132*a*. Thus, the other end (engagement pin 132*a*) of the rocking member 132 is rocked generally in a vertical direction to move accordingly the first bracket 56 vertically, whereupon the transport roller 36*b* of the first transport roller pair 36 can be contacted with or separated from the drive roller 36*a*.

The anti-positional offset mechanism for preventing positional offsets in the depth direction from the optical scan position (recording position X) characterizes the present invention. In the embodiments described above, the retaining roller pair 42 to be provided near the recording position X between the two transport roller pairs 36, 38 that are used to transport the sheets of light-sensitive material Z in the auxiliary scanning direction is provided as such device in the auxiliary scan transport unit 16 in which the transport roller pairs 36, 38 are opened or closed by the opening and closing mechanism 44 in concordance with the entry and ejection of the light-sensitive material Z. However, this is not the sole case of the invention. If the retaining roller pair 42 is provided between the two transport roller pairs 36, 38 to prevent any positional offset in the depth direction from the recording position X, these transport roller pairs between which the anti-positional offset mechanism such as the retaining roller pair 42 is provided may be opened or closed in collaboration with each other, or one of the two transport roller pairs may be opened or closed. Alternatively, both roller pairs may not be opened or closed.

In the illustrated case, the sheeting transport apparatus of the invention is applied to the recording apparatus 10 as the auxiliary scan transport unit 16. Again, this is not the sole case of the invention and the sheeting transport apparatus may of course be applied as an auxiliary scan transport unit or mechanism in optical beam scanners such as an image reading apparatus that perform optical scan as with light beams.

While the preferred embodiments of the sheeting transport apparatus of the present invention have been described above in detail, it should be understood that the invention is by no means limited to those embodiments and various improvements and design modifications may of course be made without departing from the scope and spirit of the invention.

As described above in detail, the sheeting transport apparatus of the invention is suitable for use as an auxiliary scan transport mechanism in optical beam scanners that perform image reading, recording and other operations by scan with light beams such as laser beam that are applied to sheeting such as sheets of light-sensitive material in a specified position. The apparatus is capable of suppressing the adverse effects of curl and other undesirable phenomena that occur in the advancing and trailing end portions of the sheeting; namely, any positional offsets in the depth direction, such as upward departure from the light scanning position that occurs in the advancing and trailing end portions of the sheeting due to curl and other undesirable effects are eliminated or reduced to a very small tolerable limit, thereby ensuring that the sheeting is transported smoothly and precisely in the auxiliary scanning direction as it is maintained adequately flat.

What is more, this advantage of the invention (smooth and precise transport of the sheeting in the auxiliary scanning direction while maintaining it adequately flat) can be realized without any complex mechanism but requiring only a simple, small, compact and inexpensive system configuration. Therefore, according to the invention, precise image reading and recording can be accomplished efficiently and at low cost.

The apparatus of the invention is particularly suitable for use in an image recording apparatus that is included in digital photoprinters and other systems that cut a light-sensitive material into discrete sheets before it is subjected to digital scan exposure, back printing and other operations. In this preferred case, one can record images of high quality that are free from any unevenness in density in the advancing and/or trailing end portion of the light-sensitive material in sheet form.

What is claimed is:

1. A sheeting transport apparatus that transports a sheeting on which is performed optical scan in a one-dimensional direction in an auxiliary scanning direction generally perpendicular to said one-dimensional direction, comprising:

a first roller pair and a second roller pair that are spaced apart by a distance shorter than a length of said sheeting in the auxiliary scanning direction, wherein said sheeting is transported in the auxiliary scanning direction as it is nipped by said first roller pair and said second roller pair; and an anti-positional offset mechanism that is provided between said first and second roller pairs to ensure that said sheeting has no positional offset from optical scan position in which said sheeting is scanned optically in a depth direction.

2. The sheeting transport apparatus according to claim 1, wherein said anti-positional offset mechanism is provided between said first and second roller pairs at least one of upstream and downstream of said optical scan position of said sheeting.

3. The sheeting transport apparatus according to claim 1, wherein said anti-positional offset mechanism is provided between said first and second roller pairs upstream of said optical scan position of said sheeting.

4. The sheeting transport apparatus according to claim 1, further comprising:

an optical scan guide that is provided between said first and second roller pairs to support said sheeting in said optical scan position from its underside, wherein said anti-positional offset mechanism prevents upward departure of said sheeting from said optical scan guide.

5. The sheeting transport apparatus according to claim 1, wherein said first roller pair is positioned upstream of said second roller pair and includes a first roller driven rotationally and a first nip roller that can move either toward or away from said first roller and wherein said second roller pair is positioned downstream of said first roller pair and includes a second roller driven rotationally and a second nip roller that can move either toward or away from said second roller, and said apparatus further comprising:

a first opening and closing mechanism that engages said first nip roller and advances or retracts it depending on transport of said sheeting to either open or close said first roller pair; and a second opening and closing mechanism that engages said second nip roller and advances or retracts it depending upon the transport of said sheeting to either open or close said second roller pair.

6. The sheeting transport apparatus according to claim 5, wherein said first opening and closing mechanism is any one of a cam mechanism and a drive unit thereof, a solenoid mechanism, a rotary solenoid mechanism, a rack-and-pinion mechanism and a drive unit thereof as well as a linear guide mechanism and a drive unit thereof, and wherein said second opening and closing mechanism is any one of a cam mechanism and a drive unit thereof, a solenoid mechanism, a rotary solenoid mechanism, a rack-and-pinion mechanism and a drive unit thereof as well as a linear guide mechanism and a drive unit thereof.

7. The sheeting transport apparatus according to claim 5, wherein said first opening and closing mechanism comprises a first cam mechanism and a drive unit of said first cam mechanism, and wherein said second opening and closing mechanism comprises a second cam mechanism and a drive unit of said second cam mechanism.

8. The sheeting transport apparatus according to claim 7, wherein the drive unit of said first cam mechanism and the drive unit of said second cam mechanism are a single common drive source that drives said first and second cam mechanisms in unison such that said first roller pair or said second roller pair is selectively opened and closed.

9. The sheeting transport apparatus according to claim 8, wherein said first cam mechanism has:

a first rocking member that rotatably supports said first nip roller; and a first cam member that engages said first rocking member to move said first nip roller either toward or away from said first roller;

wherein said second cam mechanism has:

a second rocking member that rotatably supports said second nip roller; and a second cam member that engages said second rocking member to move said second nip roller either toward or away from said second roller; and wherein said first and second cam members have:

a single common rotating shaft to which said single common drive source working as a rotational drive source is coupled.

10. The sheeting transport apparatus according to claim 9, wherein said first rocking member has:

a first bracket that rotatably supports said first nip roller and makes reciprocal movements to come closer to or depart from said first roller;

a first pivoting member that pivots in engagement with said first bracket member and said first cam member; and a first urging device that urges said first bracket such that said first nip roller is pressed against said first roller; and wherein said second rocking member has:

a second bracket that rotatably supports said second nip roller and makes reciprocal movements to come closer to or depart from said second roller;

a second pivoting member that pivots in engagement with said second bracket and said second cam member; and a second urging device that urges said second bracket such that said second nip roller is pressed against said second roller.

11. The sheeting transport apparatus according to claim 10, wherein said first and second cam members are a single common eccentric cam and said first and second pivoting members have a single common pivoting shaft.

12. A sheeting transport apparatus that transports a sheeting on which is performed an optical scan in a one-dimensional direction and in an auxiliary scanning direction generally perpendicular to said one-dimensional direction, comprising:

a first roller pair and a second roller pair spaced apart by a distance shorter than a length of said sheeting in the auxiliary scanning direction, wherein said sheeting is transported in the auxiliary scanning direction as it is nipped by said first roller pair and said second roller pair; and an anti-positional offset mechanism between said first and second roller pairs to ensure that said sheeting has no positional offset from an optical scan position in which said sheeting is scanned optically in a depth direction, said anti-positional offset mechanism comprising a retaining roller pair for nipping said sheeting to be held in said optical scan position and a nipping force adjusting mechanism, said retaining roller pair having a rotatable fixed roller and a rotatable retainer roller which is adjustable in a nipping force that nips said sheeting in cooperation with said fixed roller, and said nipping force adjusting mechanism engaging said retainer roller to adjust the nipping force by which said sheeting is nipped between said retainer roller and said fixed roller.

13. The sheeting transport apparatus according to claim 12, wherein said nipping force adjusting mechanism comprises a third rocking member that rotatably supports said retainer roller, a third urging device that urges said rocking member such that said retainer roller is pressed against said fixed roller, and an urging force adding device that adds or relieves an urging force by which said third urging device urges said third rocking member.

14. The sheeting transport apparatus according to claim 13, wherein said urging force adding device adds or relieves the urging force by which said third urging device urges said third rocking member depending upon whether said first nip roller is moved toward or away from said first roller by means of said first cam mechanism.

15. The sheeting transport apparatus according to claim 13, wherein said urging force adding device relies upon said first rocking member in said first cam mechanism to add or relieve the urging force by which said third urging device urges said third rocking member.

16. The sheeting transport apparatus according to claim 13, wherein said urging force adding device further includes a fourth rocking member that engages said first bracket in said first rocking member in said first cam mechanism, said third rocking member has a rocking shaft through said fourth rocking member, said third urging device urges said third rocking member with respect to said fourth rocking member, and the reciprocal movements of said first bracket help add and relieve the urging force by which said third urging device urges said third rocking member.

17. The sheeting transport apparatus according to 13, wherein said third rocking member is split into more than one segment in said main scanning direction and each segment has said retainer roller, said fixed roller and said third urging device.

18. The sheeting transport apparatus according to claim 17, wherein said retainer roller for each segment is subdivided into smaller sub-segment rollers, said fixed roller for each segment is subdivided into two subdivided rollers that are provided only at both ends of said third rocking member and that are respectively in contact with the smaller sub-segment rollers of said retainer roller at both ends.

19. The sheeting transport apparatus according to claim 12, wherein each of said retainer roller and said fixed roller has split rollers.

20. The sheeting transport apparatus according to claim 12, wherein said fixed roller is rotatably supported on said optical scan guide.

21. The sheeting transport apparatus according to claim 12, wherein said sheeting transport apparatus is an auxiliary scan transport mechanism of an image recording apparatus and said sheeting is a light-sensitive material, and wherein said fixed roller is provided so as to avoid a back print position or back print positions used for back printing with a back printer, when said image recording apparatus comprises the back printer.

22. The sheeting transport apparatus according to claim 12, wherein said optical scan guide has a plurality of curved pawls in a comb shape which are provided in said one-dimensional direction, which extend upstream in said auxiliary scanning direction and each of which has a forward end being curved inwardly.

23. The sheeting transport apparatus according to claim 22, wherein said optical scan guide has a plurality of straight pawls in a comb shape which are provided in said one-dimensional direction and which extend downstream in said auxiliary scanning direction.

* * * * *